US007237623B2

(12) United States Patent
Hannegan

(10) Patent No.: US 7,237,623 B2
(45) Date of Patent: Jul. 3, 2007

(54) METHOD FOR PRESSURIZED MUD CAP AND REVERSE CIRCULATION DRILLING FROM A FLOATING DRILLING RIG USING A SEALED MARINE RISER

(75) Inventor: Don Hannegan, Fort Smith, AR (US)

(73) Assignee: Weatherford/Lamb, Inc., Houston, TX (US)

( * ) Notice: Subject to any disclaimer, the term of this patent is extended or adjusted under 35 U.S.C. 154(b) by 172 days.

(21) Appl. No.: 10/666,088

(22) Filed: Sep. 19, 2003

(65) Prior Publication Data

US 2005/0061546 A1 Mar. 24, 2005

(51) Int. Cl.
*E21B 7/128* (2006.01)

(52) U.S. Cl. ..... 175/7; 175/195

(58) Field of Classification Search ..... 175/5, 175/7, 10, 195; 166/358
See application file for complete search history.

(56) References Cited

U.S. PATENT DOCUMENTS

| | | | |
|---|---|---|---|
| 517,509 | A | 4/1894 | Williams |
| 1,157,644 | A | 10/1915 | London |
| 1,472,952 | A | 11/1923 | Anderson |
| 1,503,476 | A | 8/1924 | Childs et al. |
| 1,528,560 | A | 3/1925 | Myers et al. |
| 1,546,467 | A | 7/1925 | Bennett |
| 1,560,763 | A | 11/1925 | Collins |

(Continued)

FOREIGN PATENT DOCUMENTS

AU 199927822 B2 9/1999

(Continued)

OTHER PUBLICATIONS

*Supplementary European Search Report* No. EP 99908371, 3 pages (Date of Completion Oct. 22, 2004).

(Continued)

*Primary Examiner*—William Neuder
(74) *Attorney, Agent, or Firm*—Strasburger & Price, LLP

(57) ABSTRACT

A method for drilling in the floor of an ocean from a floating structure using a rotatable tubular includes a seal housing having a rotatable seal connected above a portion of a marine riser fixed to the floor of the ocean. The seal rotating with the rotating tubular allows the riser and seal housing to maintain a predetermined pressure in the system that is desirable in pressurized mud cap and reverse circulation drilling. A flexible conduit or hose is used to compensate for relative movement of the seal housing and the floating structure because the floating structure moves independent of the seal housing. The drilling fluid is pumped from the floating structure into an annulus of the riser, allowing the formation of a mud cap downhole in the riser, or allowing reverse circulation of the drilling fluid down the riser, returning up the rotatable tubular to the floating structure.

52 Claims, 14 Drawing Sheets

U.S. PATENT DOCUMENTS

| | | | |
|---|---|---|---|
| 1,700,894 | A | 2/1929 | Joyce et al. |
| 1,708,316 | A | 4/1929 | MacClatchie |
| 1,769,921 | A | 7/1930 | Hansen |
| 1,776,797 | A | 9/1930 | Sheldon |
| 1,813,402 | A | 7/1931 | Hewitt |
| 1,831,956 | A | 11/1931 | Harrington |
| 1,836,470 | A | 12/1931 | Humason et al. |
| 1,902,906 | A | 3/1933 | Seamark |
| 1,942,366 | A | 1/1934 | Seamark |
| 2,036,537 | A | 4/1936 | Otis |
| 2,071,197 | A | 2/1937 | Burns et al. |
| 2,124,015 | A | 7/1938 | Stone et al. |
| 2,126,007 | A | 8/1938 | Guiberson et al. |
| 2,144,682 | A | 1/1939 | MacClatchie |
| 2,163,813 | A | 6/1939 | Stone et al. |
| 2,165,410 | A | 7/1939 | Penick et al. |
| 2,170,915 | A | 8/1939 | Schweitzer |
| 2,170,916 | A | 8/1939 | Schweitzer et al. |
| 2,175,648 | A | 10/1939 | Roach |
| 2,176,355 | A | 10/1939 | Otis |
| 2,185,822 | A | 1/1940 | Young |
| 2,199,735 | A | 5/1940 | Beckman |
| 2,222,082 | A | 11/1940 | Leman et al. |
| 2,233,041 | A | 2/1941 | Alley |
| 2,243,340 | A | 5/1941 | Hild |
| 2,243,439 | A | 5/1941 | Pranger et al. |
| 2,287,205 | A | 6/1942 | Stone |
| 2,303,090 | A | 11/1942 | Pranger et al. |
| 2,313,169 | A | 3/1943 | Penick et al. |
| 2,325,556 | A | 7/1943 | Taylor, Jr. et al. |
| 2,338,093 | A | 1/1944 | Caldwell |
| 2,480,955 | A | 9/1949 | Penick |
| 2,506,538 | A | 5/1950 | Bennett |
| 2,529,744 | A | 11/1950 | Schweitzer |
| 2,609,836 | A | 9/1952 | Knox |
| 2,628,852 | A | 2/1953 | Voytech |
| 2,646,999 | A | 7/1953 | Barske |
| 2,649,318 | A | 8/1953 | Skillman |
| 2,731,281 | A | 1/1956 | Knox |
| 2,746,781 | A | 5/1956 | Jones |
| 2,760,750 | A | 8/1956 | Schweitzer, Jr. et al. |
| 2,760,795 | A | 8/1956 | Vertson |
| 2,764,999 | A | 10/1956 | Stanbury |
| 2,808,229 | A | 10/1957 | Bauer et al. |
| 2,808,230 | A | 10/1957 | McNeill et al. |
| 2,846,178 | A | 8/1958 | Minor |
| 2,846,247 | A | 8/1958 | Davis |
| 2,853,274 | A | 9/1958 | Collins |
| 2,862,735 | A | 12/1958 | Knox |
| 2,886,350 | A | 5/1959 | Horne |
| 2,904,357 | A | 9/1959 | Knox |
| 2,927,774 | A | 3/1960 | Ormsby |
| 2,929,610 | A | 3/1960 | Stratton |
| 2,995,196 | A | 8/1961 | Gibson et al. |
| 3,023,012 | A | 2/1962 | Wilde |
| 3,029,083 | A | 4/1962 | Wilde |
| 3,032,125 | A | 5/1962 | Hiser et al. |
| 3,033,011 | A | 5/1962 | Garrett |
| 3,052,300 | A | 9/1962 | Hampton |
| 3,100,015 | A | 8/1963 | Regan |
| 3,128,614 | A | 4/1964 | Auer |
| 3,134,613 | A | 5/1964 | Regan |
| 3,176,996 | A | 4/1965 | Barnett |
| 3,203,358 | A | 8/1965 | Regan et al. |
| 3,209,829 | A | 10/1965 | Haeber |
| 3,216,731 | A | 11/1965 | Dollison |
| 3,225,831 | A | 12/1965 | Knox |
| 3,259,198 | A | 7/1966 | Montgomery et al. |
| 3,268,233 | A | 8/1966 | Brown |
| 3,285,352 | A | 11/1966 | Hunter |
| 3,288,472 | A | 11/1966 | Watkins |
| 3,289,761 | A | 12/1966 | Smith et al. |
| 3,294,112 | A | 12/1966 | Watkins |
| 3,313,345 | A | 4/1967 | Fischer |
| 3,313,358 | A | 4/1967 | Postlewaite et al. |
| 3,323,773 | A | 6/1967 | Walker |
| 3,333,870 | A | 8/1967 | Watkins |
| 3,347,567 | A | 10/1967 | Watkins |
| 3,360,048 | A | 12/1967 | Watkins |
| 3,372,761 | A | 3/1968 | van Gils |
| 3,387,851 | A | 6/1968 | Cugini |
| 3,397,928 | A | 8/1968 | Galle |
| 3,400,938 | A | 9/1968 | Williams |
| 3,405,763 | A | 10/1968 | Pitts et al. |
| 3,421,580 | A | 1/1969 | Fowler et al. |
| 3,443,643 | A | 5/1969 | Jones |
| 3,445,126 | A | 5/1969 | Watkins |
| 3,452,815 | A | 7/1969 | Watkins |
| 3,472,518 | A | 10/1969 | Harlan |
| 3,476,195 | A | 11/1969 | Galle |
| 3,485,051 | A | 12/1969 | Watkins |
| 3,492,007 | A | 1/1970 | Jones |
| 3,493,043 | A | 2/1970 | Watkins |
| 3,529,835 | A | 9/1970 | Lewis |
| 3,583,480 | A | 6/1971 | Regan |
| 3,587,734 | A | 6/1971 | Shaffer |
| 3,603,409 | A | 9/1971 | Watkins |
| 3,621,912 | A | 11/1971 | Wooddy, Jr. |
| 3,631,834 | A | 1/1972 | Gardner et al. |
| 3,638,721 | A | 2/1972 | Harrison |
| 3,638,742 | A | 2/1972 | Wallace |
| 3,653,350 | A | 4/1972 | Koons et al. |
| 3,661,409 | A | 5/1972 | Brown et al. |
| 3,664,376 | A | 5/1972 | Watkins |
| 3,667,721 | A | 6/1972 | Vujasinovic |
| 3,677,353 | A | 7/1972 | Baker |
| 3,724,862 | A | 4/1973 | Biffle |
| 3,779,313 | A | 12/1973 | Regan |
| 3,815,673 | A | 6/1974 | Bruce et al. |
| 3,827,511 | A | 8/1974 | Jones |
| 3,847,215 | A | 11/1974 | Herd |
| 3,868,832 | A | 3/1975 | Biffle |
| 3,924,678 | A | 12/1975 | Ahlstone |
| 3,934,887 | A | 1/1976 | Biffle |
| 3,952,526 | A | 4/1976 | Watkins et al. |
| 3,955,622 | A | 5/1976 | Jones |
| 3,965,987 | A | 6/1976 | Biffle |
| 3,976,148 | A | 8/1976 | Maus et al. |
| 3,984,990 | A | 10/1976 | Jones |
| 3,992,889 | A | 11/1976 | Watkins et al. |
| 3,999,766 | A | 12/1976 | Barton |
| 4,037,890 | A | 7/1977 | Kurita et al. |
| 4,046,191 | A | 9/1977 | Neath |
| 4,053,023 | A | 10/1977 | Herd et al. |
| 4,063,602 | A | 12/1977 | Howell et al. |
| 4,091,881 | A | 5/1978 | Maus |
| 4,098,341 | A | 7/1978 | Lewis |
| 4,099,583 | A | 7/1978 | Maus |
| 4,109,712 | A | 8/1978 | Regan |
| 4,143,880 | A | 3/1979 | Bunting et al. |
| 4,143,881 | A | 3/1979 | Bunting |
| 4,149,603 | A | 4/1979 | Arnold |
| 4,154,448 | A | 5/1979 | Biffle |
| 4,157,186 | A | 6/1979 | Murray et al. |
| 4,183,562 | A | 1/1980 | Watkins et al. |
| 4,200,312 | A | 4/1980 | Watkins |
| 4,208,056 | A | 6/1980 | Biffle |
| 4,222,590 | A | 9/1980 | Regan |
| 4,281,724 | A | 8/1981 | Garrett |
| 4,282,939 | A | 8/1981 | Maus et al. |
| 4,285,406 | A | 8/1981 | Garrett et al. |
| 4,291,772 | A | 9/1981 | Beynet |
| 4,293,047 | A | 10/1981 | Young |
| 4,304,310 | A | 12/1981 | Garrett |

4,310,058 A 1/1982 Bourgoyne, Jr.
4,312,404 A 1/1982 Morrow
4,313,054 A 1/1982 Martini
4,326,584 A 4/1982 Watkins
4,335,791 A 6/1982 Evans
4,349,204 A 9/1982 Malone
4,353,420 A 10/1982 Miller
4,355,784 A 10/1982 Cain
4,361,185 A 11/1982 Biffle
4,363,357 A 12/1982 Hunter
4,367,795 A 1/1983 Biffle
4,378,849 A 4/1983 Wilks
4,383,577 A 5/1983 Pruitt
4,386,667 A 6/1983 Millsapps, Jr.
4,398,599 A 8/1983 Murray
4,406,333 A 9/1983 Adams
4,407,375 A 10/1983 Nakamura
4,413,653 A 11/1983 Carter, Jr.
4,416,340 A 11/1983 Bailey
4,423,776 A 1/1984 Wagoner et al.
4,424,861 A 1/1984 Carter, Jr. et al.
4,440,232 A 4/1984 LeMoine
4,441,551 A 4/1984 Biffle
4,444,250 A 4/1984 Keithahn et al.
4,444,401 A 4/1984 Roche et al.
4,448,255 A 5/1984 Shaffer et al.
4,456,062 A 6/1984 Roche et al.
4,456,063 A 6/1984 Roche
4,480,703 A 11/1984 Garrett
4,484,753 A 11/1984 Kalsi
4,486,025 A 12/1984 Johnston
4,500,094 A 2/1985 Biffle
4,502,534 A 3/1985 Roche et al.
4,509,405 A 4/1985 Bates
4,524,832 A 6/1985 Roche et al.
4,526,243 A 7/1985 Young
4,527,632 A 7/1985 Chaudot
4,529,210 A 7/1985 Biffle
4,531,580 A 7/1985 Jones
4,531,593 A 7/1985 Elliott et al.
4,540,053 A 9/1985 Baugh et al.
4,546,828 A 10/1985 Roche
4,553,591 A 11/1985 Mitchell
D282,073 S 1/1986 Bearden et al.
4,566,494 A 1/1986 Roche
4,595,343 A 6/1986 Thompson et al.
4,597,447 A 7/1986 Roche et al.
4,597,448 A 7/1986 Baugh
4,611,661 A 9/1986 Hed et al.
4,615,544 A 10/1986 Baugh
4,618,314 A 10/1986 Hailey
4,621,655 A 11/1986 Roche
4,626,135 A 12/1986 Roche
4,632,188 A 12/1986 Schuh et al.
4,646,826 A 3/1987 Bailey et al.
4,646,844 A 3/1987 Roche et al.
4,690,220 A 9/1987 Braddick
4,697,484 A 10/1987 Klee et al.
4,709,900 A 12/1987 Dyhr
4,712,620 A 12/1987 Lim et al.
4,719,937 A 1/1988 Roche et al.
4,722,615 A 2/1988 Bailey et al.
4,727,942 A 3/1988 Galle et al.
4,736,799 A 4/1988 Ahlstone
4,745,970 A 5/1988 Bearden et al.
4,749,035 A 6/1988 Cassity
4,754,820 A 7/1988 Watts et al.
4,759,413 A 7/1988 Bailey et al.
4,765,404 A 8/1988 Bailey et al.
4,783,084 A 11/1988 Biffle
4,807,705 A 2/1989 Henderson et al.
4,813,495 A 3/1989 Leach
4,817,724 A 4/1989 Funderburg, Jr. et al.
4,825,938 A 5/1989 Davis
4,828,024 A 5/1989 Roche
4,832,126 A 5/1989 Roche
4,836,289 A 6/1989 Young
4,909,327 A 3/1990 Roche
4,949,796 A 8/1990 Williams
4,955,436 A 9/1990 Johnston
4,955,949 A 9/1990 Bailey et al.
4,962,819 A 10/1990 Bailey et al.
4,971,148 A 11/1990 Roche et al.
4,984,636 A 1/1991 Bailey et al.
4,995,464 A 2/1991 Watkins et al.
5,009,265 A 4/1991 Bailey et al.
5,022,472 A 6/1991 Bailey et al.
5,028,056 A 7/1991 Bemis et al.
5,040,600 A 8/1991 Bailey et al.
5,062,479 A 11/1991 Bailey et al.
5,072,795 A 12/1991 Delgado et al.
5,076,364 A 12/1991 Hale et al.
5,085,277 A 2/1992 Hopper
5,137,084 A 8/1992 Gonzales et al.
5,154,231 A 10/1992 Bailey et al.
5,163,514 A 11/1992 Jennings
5,178,215 A 1/1993 Yenulis et al.
5,184,686 A 2/1993 Gonzalez
5,195,754 A 3/1993 Dietle
5,213,158 A 5/1993 Bailey et al.
5,215,151 A 6/1993 Smith et al.
5,224,557 A 7/1993 Yenulis et al.
5,230,520 A 7/1993 Dietle et al.
5,251,869 A 10/1993 Mason
5,277,249 A 1/1994 Yenulis et al.
5,279,365 A 1/1994 Yenulis et al.
5,305,839 A 4/1994 Kalsi et al.
5,320,325 A 6/1994 Young et al.
5,322,137 A 6/1994 Gonzales
5,325,925 A 7/1994 Smith et al.
5,348,107 A 9/1994 Bailey et al.
5,443,129 A 8/1995 Bailey et al.
5,607,019 A 3/1997 Kent
5,647,444 A 7/1997 Williams
5,662,171 A 9/1997 Brugman et al.
5,662,181 A 9/1997 Williams et al.
5,671,812 A 9/1997 Bridges
5,678,829 A 10/1997 Kalsi et al.
5,738,358 A 4/1998 Kalsi et al.
5,823,541 A 10/1998 Dietle et al.
5,829,531 A 11/1998 Hebert et al.
5,848,643 A 12/1998 Carbaugh et al.
5,873,576 A 2/1999 Dietle et al.
5,878,818 A 3/1999 Hebert et al.
5,901,964 A 5/1999 Williams et al.
5,944,111 A 8/1999 Bridges
6,007,105 A 12/1999 Dietle et al.
6,016,880 A 1/2000 Hall et al.
6,036,192 A 3/2000 Dietle et al.
6,102,123 A 8/2000 Bailey et al.
6,102,673 A 8/2000 Mott et al.
6,109,348 A 8/2000 Caraway
6,109,618 A 8/2000 Dietle
6,129,152 A 10/2000 Hosie et al.
6,138,774 A 10/2000 Bourgoyne et al.
6,202,745 B1 3/2001 Reimert et al.
6,213,228 B1 4/2001 Saxman
6,227,547 B1 5/2001 Dietle et al.
6,230,824 B1 5/2001 Peterman et al.
6,244,359 B1 6/2001 Bridges et al.
6,263,982 B1 7/2001 Hannegan et al.
6,325,159 B1 12/2001 Peterman et al.
6,354,385 B1 3/2002 Ford et al.
6,450,262 B1 9/2002 Regan
6,457,529 B2 10/2002 Calder et al.
6,470,975 B1 10/2002 Bourgoyne et al.

| | | | |
|---|---|---|---|
| 6,478,303 | B1 | 11/2002 | Radcliffe |
| 6,547,002 | B1 | 4/2003 | Bailey et al. |
| 6,554,016 | B2 | 4/2003 | Kinder |
| 6,655,460 | B2 | 12/2003 | Bailey et al. |
| 6,702,012 | B2 | 3/2004 | Bailey et al. |
| 6,732,804 | B2 | 5/2004 | Hosie et al. |
| 6,749,172 | B2 | 6/2004 | Kinder |
| 6,843,313 | B2 | 1/2005 | Hult |
| 6,896,076 | B2 | 5/2005 | Nelson et al. |
| 6,913,092 | B2 | 7/2005 | Bourgoyne et al. |
| 7,004,444 | B2 | 2/2006 | Kinder |
| 7,007,913 | B2 | 3/2006 | Kinder |
| 7,025,130 | B2 | 4/2006 | Bailey et al. |
| 7,028,777 | B2 | 4/2006 | Wade et al. |
| 7,032,691 | B2 | 4/2006 | Humphreys |
| 7,040,394 | B2 | 5/2006 | Bailey et al. |
| 7,077,212 | B2 | 7/2006 | Roesner et al. |
| 7,080,685 | B2 | 7/2006 | Bailey et al. |
| 2001/0040052 | A1 | 11/2001 | Bourgoyne et al. |
| 2003/0070842 | A1 | 4/2003 | Bailey et al. |
| 2003/0106712 | A1 | 6/2003 | Bourgoyne et al. |
| 2003/0121671 | A1 | 7/2003 | Bailey et al. |
| 2004/0055755 | A1 | 3/2004 | Roesner et al. |
| 2004/0084220 | A1 | 5/2004 | Bailey et al. |
| 2004/0108108 | A1 | 6/2004 | Bailey et al. |
| 2005/0000698 | A1 | 1/2005 | Bailey et al. |
| 2005/0151107 | A1 | 7/2005 | Shu |
| 2005/0241833 | A1 | 11/2005 | Bailey et al. |
| 2006/0102387 | A1 | 5/2006 | Bourgoyne et al. |
| 2006/0108119 | A1 | 5/2006 | Bailey et al. |

FOREIGN PATENT DOCUMENTS

| | | | |
|---|---|---|---|
| AU | 200028183 | A1 | 9/2000 |
| AU | 200028183 | B2 | 9/2000 |
| CA | 2363132 | A1 | 9/2000 |
| CA | 2447196 | A1 | 4/2004 |
| EP | 0290250 | A2 | 11/1988 |
| EP | 0290250 | A3 | 11/1988 |
| EP | 267140 | B1 | 3/1993 |
| GB | 2067235 | A | 7/1981 |
| GB | 2394741 | A | 5/2004 |
| WO | WO 99/45228 | A1 | 9/1999 |
| WO | WO 99/50524 | A2 | 10/1999 |
| WO | WO 99/51852 | A1 | 10/1999 |
| WO | WO 99/50524 | A3 | 12/1999 |
| WO | WO00/52299 | A | 9/2000 |
| WO | WO 00/52299 | A1 | 9/2000 |
| WO | WO 00/52300 | A1 | 9/2000 |

OTHER PUBLICATIONS

Terwogt, Jan, "Pressured Mud Cap Drilling—Advanced Well Control for Subsea Wells," Petromin Subsea Asia Conference, Kuala Lumpur, Malaysia, 8 pages (Sep. 20-21, 2004).

*PCT Search Report*, International Application No. PCT/EP2004/052167, 4 pages (Date of Completion Nov. 25, 2004).

*PCT Written Opinion of the International Searching Authority*, International Application No. PCT/EP2004/052167, 6 pages.

Helio Santos, Email message to Don Hannegan, et al., 1 page, (Aug. 20, 2001).

Boyle, John; "Multi Purpose Intervention Vessel Presentation," M.O.S.T. Multi Operational Service Tankers, Weatherford International, Jan. 2004, 43 pages, (© 2003).

GB Search Report, International Application No. GB 0324939.8, 1 page (Jan. 21, 2004).

U.S. Appl. No. 60/079,641, filed Mar. 27, 1998, Abandoned, but Priority Claimed in above U.S. Patent Nos. 6,230,824B1 and 6,102,673 and PCT WO 99/50524.

The Modular T BOP Stack System, Cameron Iron Works © 1985 (5 pages).

Cameron HC Collet Connector, © 1996 Cooper Cameron Corporation, Cameron Division (12 pages).

Riserless drilling: circumventing the size/cost cycle in deepwater—Conoco, Hydril project seek enabling technologies to drill in deepest water depths economically, May 1996 Offshore Drilling Technology (pp. 49, 50, 52, 53, 54 and 55).

Williams Tool Company—Home Page—Under Construction Williams Rotating Control Heads (2 pages); Seal-Ability for the pressures of drilling (2 pages); Williams Model 7000 Series Rotating Control Heads (1 page); Williams Model 7000 & 7100 Series Rotating Control Heads (2 pages); Williams Model IP1000 Rotating Control Head (2 pages); Williams Conventional Models 8000 & 9000 (2 pages); Applications Where using a Williams rotating control head while drilling is a plus (1 page); Williams higher pressure rotating control head systems are Ideally Suited for New Technology Flow Drilling and Closed Loop Underbalanced Drilling (UBD) Vertical and Horizontal (2 pages); and How to Contact Us (2 pages).

Offshore—World Trends and Technology for Offshore Oil and Gas Operations, Mar. 1998, Seismic: Article entitled, "Shallow Flow Diverter JIP Spurred by Deepwater Washouts" (3 pages including cover page, table of contents and p. 90).

Williams Tool Co., Inc. Rotating Control Heads and Strippers for Air, Gas, Mud, and Geothermal Drilling Worldwide—Sales Rental Service, © 1988 (19 pages).

Williams Tool Co., Inc. 19 page brochure © 1991 Williams Tool Co., Inc. (19 pages).

Fig. 14. Floating Piston Drilling Choke Design; May of 1997.

Blowout Preventer Testing for Underbalanced Drilling by Charles R. "Rick" Stone and Larry A. Cress, Signa Engineering Corp., Houston, Texas, 24 pages, (Undated).

Williams Tool Co., Inc. Instructions, Assemble & Disassemble Model 9000 Bearing Assembly (cover page and 27 numbered pages).

Williams Tool Co., Inc. Rotating Control Heads Making Drilling Safer While Reducing Costs Since 1968, © 1989 (4 pages).

Williams Tool Company, Inc. International Model 7000 Rotating Control Head, © 1991 (4 pages).

Williams Rotating Control Heads, Reduce Costs Increase Safety Reduce Environmental Impact, 4 pages, (© 1995).

Williams Tool Co., Inc., Sales-Rental-Service, Williams Rotating Control Heads and Strippers for Air, Gas, Mud, and Geothermal Drilling, © 1982 (7 pages).

Williams Tool Co., Inc., Rotating Control Heads and Strippers for Air, Gas, Mud, Geothermal and Pressure Drilling, © 1991 (19 pages).

An article—The Brief Jan. '96, The Brief's Guest Columnists, Williams Tool Co., Inc., Communicating Dec. 13, 1995 (Fort Smith, Arkansas) The *When?* and *Why?* of Rotating Control Head Usage, Copyright © Murphy Publishing, Inc. 1996 (2 pages).

A reprint from the Oct. 9, 1995 edition of Oil & Gas Journal, "Rotating control head applications increasing", by Adam T. Bourgoyne, Jr., Copyright 1995 by PennWell Publishing Company (4 pages).

1966-1967 Composite Catalog-Grant Rotating Drilling Head for Air, Gas or Mud Drilling, (1 page).

1976-1977 Composite Catalog Grant Oil Tool Company Rotating Drilling Head Models 7068, 7368, 8068 (Patented), Equally Effective with Air, Gas, or Mud Circulation Media (3 pages).

A Subsea Rotating Control Head for Riserless Drilling Applications; Darryl A. Bourgoyne, Adam T. Bourgoyne, and Don Hannegan—1998 International Association of Drilling Contractors International Deep Water Well Control Conference held in Houston, Texas, Aug. 26-27, 1998, 14 pages.

Hannegan, "Applications Widening for Rotating Control Heads," Drilling Contractor, cover page, table of contents and pp. 17 and 19, Drilling Contractor Publications Inc., Houston, Texas, Jul. 1996.

Composite Catalog, Hughes Offshore 1986-87 Subsea Systems and Equipment, Hughes Drilling Equipment Composite Catalog, two cover sheets and pp. 2988-3004.

Williams Tool Co., Inc., Technical Specification Model for The Model. 7100, 3 pages.

Williams Tool Co., Inc. Website, Underbalanced Drilling (UBD), The Attraction of UBD 2 pages.

Williams Tool Co., Inc. Website, "Applications, Where Using a Williams Rotating Control Head While Drilling is a Plus," 2 pages.
Williams Tool Co., Inc. Website, "Model 7100," 3 pages.
Composite Catalog, Hughes Offshore 1982/1983, Regan Products, © Copyright 1982, Two cover sheets and 4308-27 thru 4308-43, and end sheet.
Coflexip Brochure; 1-Coflexip Sales Offices, 2-The Flexible Steel Pipe for Drilling and Service Applications, 3-New 5" I.D. General Drilling Flexible, 4-Applications, and 5-Illustrations, 5 unnumbered pages.
Baker, Ron, "A Primer of Oilwell Drilling", Fourth Edition, Published by Petroleum Extension Service, The University of Texas at Austin, Austin, Texas, in cooperation with International Association of Drilling Contractors Houston Texas © 1979, 3 cover pages and pp. 42-49 re Circulation System.
Brochure, Lock down Lubricator System, Dutch Enterprises Inc., "Safety with Savings," pp. D-3 through D-18, See above U.S. Patent No. 4,836,289 referred to therein.
Hydril GL series Annular Blowout Preventors (Patented—see Roche patents above), 2pages, (© 1998).
Other Hydril Product Information (The GH Gas Handler Series Product is Listed), © 1996, Hydril Company, pp. D-29 through D-47.
Brochure, Shaffer Type 79 Rotating Blowout Preventer, NL Rig Equipment/NL Industries, Inc., pp. D-49 thru D-54.
Shaffer, A Varco Company, Cover page and pp. 1562-1568.
Avoiding Explosive Unloading of Gas in a Deep Water Riser When SOBM is in Use; Colin P. Leach & Joseph R. Roche; (The Paper Describes an Application for the Hydril Gas Handler, The Hydril GH 211-2000 Gas Handler is Depicted in Figure 1 of the Paper), 9 unnumbered pages, (Undated).
Feasibility Study of Dual Density Mud System for Deepwater Drilling Operations; Clovis A. Lopes & A.T. Bourgoyne Jr.; Offshore Technology Conference Paper No. 8465, pp. 257-266, (© 1997).
Apr. 1998 Offshore Drilling with Light Weight Fluids Joint Industry Project Presentation, pp. C-3 through C-11.
Nakagawa, Edson Y., Santos, Helio and Cunha, J.C., "Application of Aerated-Fluid Drilling in Deepwater", SPE/IADC 52787 Presented by Don Hannegan, P.E., SPE © 1999 SPE/IADC Drilling Conference, Amsterdam, Holland, 5 unnumbered pages, (Mar. 9-11, 1999).
Brochure: "Inter-Tech Drilling Solutions Ltd.'s RBOP™ Means Safety and Experience for Underbalanced Drilling", Inter-Tech Drilling Solutions Ltd./Big D Rentals & Sales (1981) Ltd., "Rotating BOP," 2 unnumbered pages.
"Pressure Control While Drilling", Shaffer® A Varco Company, Rev. A, 2 unnumbered pages.
Field Exposure (As of Aug. 1998), Shaffer® A Varco Company, 1 unnumbered page.
Graphic: "Rotating Spherical BOP," 1 unnumbered page.
"JIP's Work Brightens Outlook for UBD in Deep Waters" by Edson Yoshihito Nakagawa Helio Santos and Jose Carlos Cunha American Oil & Gas Reporter, pp. 52-53 56, 58-60, and 62-63, (Apr. 1999).
"Seal-Tech 1500 PSI Rotating Blowout Preventer", 3 unnumbered pages, (Undated).
"RPM System 3000™ Rotating Blowout Preventer, Setting a new standard in Well Control", by Techcorp Industries, 4 unnumbered pages, (Undated).
"RiserCap™ Materials Presented at the 1999 LSU/MMS/IADC Well Control Workshop", by Williams Tool Company, Inc., pp. 1-14, (Mar. 24-25, 1999).
"The 1999 LSU/MMS Well Control Workshop: An overview," By John Rogers Smith, World Oil, Cover page and pp. 4, 41-42, and 44-45, (Jun. 1999).
Dag Oluf Nessa, "Offshore underbalanced drilling system could revive field developments," World Oil, vol. 218, No. 10, Color Copies of Cover Page and pp. 3, 83-84, 86, and 88, (Oct. 1997).
D. O. Nessa, "*Offshore underbalanced drilling system could revive field developments*", World Oil Exploration Drilling Production, vol. 218 No. 7, Color copies of Cover Page and pp. 3, 61-64, and 66, (Jul. 1997).
*PCT Search Report*, International Application No. PCT/US99/06695, 4 pages, (Date of Completion May 27, 1999).
*PCT Search Report*, International Application No. PCT/GB00/00731, 3 pages, (Date of Completion Jun. 16, 2000).
National Academy of Sciences—National Research Council, "*Design of a Deep Ocean Drilling Ship*", Cover Page and pp. 114-121, Undated but cited in above U.S. Patent No. 6,230,824B1.
"History and Development of a Rotating Blowout Preventer," by A. Cress, Clayton W. Williams, Rick Stone, and Mike Tangedahl, IADC/SPE 23931, 1992 IADC/SPE Drilling Conference, pp. 757-773, (Feb. 1992).
Rehm, Bill, "Practical Underbalanced Drilling and Workover," Petroleum Extension Service, The University of Texas at Austin Continuing & Extended Education, Cover page, title page, copyright page, and pp. 6-6, 11-2, 11-3, G-9, and G-10, (2002).
Williams Tool Company Inc., "*RISERCAP™: Rotating Control Head System For Floating Drilling Rig Applications*", 4 unnumbered pages, (© 1999 Williams Tool Company, Inc.), see reference to above U.S. Patent No. 5,662,181.
Antonio C.V.M. Lage, Helio Santos and Paulo R.C. Silva, *Drilling With Aerated Drilling Fluid From a Floating Unit Part 2: Drilling the Well*, SPE 71361, 11 pages, (© 2001, Society of Petroleum Engineers Inc.).
Helio Santos, Fabio Rosa, and Christian Leuchtenberg, *Drilling with Aerated Fluid from a Floating Unit, Part 1: Planning, Equipment, Tests, and Rig Modifications*, SPE/IADC 67748, 8 pages, (© 2001 SPE/IADC Drilling Conference).
E. Y. Nakagawa, H. Santos, J. C. Cunha and S. Shayegi, *Planning of Deepwater Drilling Operations with Aerated Fluids*, SPE 54283, 7 pages, (© 1999, Society of Petroleum Engineers Inc.).
E. Y. Nakagawa, H.M.R. Santos and J.C. Cunha, *Implementing the Light-Weight Fluids Drilling Technology in Deepwater Scenarios*, 1999 LSU/MMS Well Control Workship Mar. 24-25, 1999, 12 pages, paper and powerpoint presentation, (1999).
Press Release: "Stewart & Stevenson Introduces First Dual Gradient Riser," Stewart & Stevenson, http:www.ssss.com/ssss/20000831.asp, 2 pages (Aug. 31, 2000).
Williams Tool Company Inc., "*Williams Tool Company Introduces the . . . Virtual Riser™*," 4 unnumbered pages, (© 1998 Williams Tool Company, Inc.).
"PETEX Publications." Petroleum Extension Service, University of Texas at Austin, 12 pages, (last modified Dec. 6, 2002).
"BG in the Caspian region," SPE Review, Issue 164, 3 unnumbered pages, (May 2003).
"Field Cases as of Mar. 3, 2003," Impact Fluid Solutions, 6 pages, (Mar. 3, 2003).
"Determine the Safe Application of Underbalanced Drilling Techniques in Marine Environments—Technical Proposal," Maurer Technology, Inc., Cover Page and pp. 2-13, (Jun. 17, 2002).
Colbert, John W, "John W. Colbert, P.E. Vice President Engineering Biographical Data," Signa Engineering Corp., 2 unnumbered pages, (undated).
"Technical Training Courses," Parker Drilling Co., http://www.parkerdrilling.com/news/tech.html, 5 pages, (last visited, Sep. 5, 2003).
"Drilling equipment: Improvements from data recording to slim hole," Drilling Contractor, pp. 30-32, (Mar./Apr. 2000).
"Drilling conference promises to be informative," Drilling Contractor, p. 10, (Jan./Feb. 2002).
"Underbalanced and Air Drilling," OGCI, Inc., http://www.ogci.com/course_info.asp?courseID=410, 2 pages, (2003).
"2003 SPE Calendar," Society of Petroleum Engineers, Google cache of http://www.spe.org/spe/cda/views/events/eventMaster/0,1470,1648_2194_632303,00.html; for "mud cap drilling," 2 pages, (2001).
"Oilfield Glossary: reverse-circulating valve," Schlumberger Limited, 1 page (2003).
Murphy, Ross D. and Thompson, Paul B., "A drilling contractor's view of underbalanced drilling," World Oil Magazine, vol. 223, No. 5, 9 pages, (May 2002).
"Weatherford UnderBalanced Services: General Underbalance Presentation to the DTI," 71 unnumbered pages, © 2002.

Rach, Nina M., "Underbalanced, near-balanced drilling are possible offshore," Oil & Gas Journal, Color Copies, pp. 39-44, (Dec. 1, 2003).
Forrest, Neil; Bailey, Tom; Hannegan, Don; "Subsea Equipment for Deep Water Drilling Using Dual Gradient Mud System," SPE/IADC 67707, pp. 1-8, (© 2001, SPE/IADC Drilling Conference).
Hannegan, D.M.; Bourgoyne Jr., A.T.; "Deepwater Drilling with Lightweight Fluids—Essential Equipment Required," SPE/IADC 67708, pp. 1-6, (© 2001, SPE/IADC Drilling Conference).
Hannegan, Don M., "Underbalanced Operations Continue Offshore Movement," SPE 68491, pp. 1-3, (© 2001, Society of Petroleum Engineers, Inc.).
Hannegan, D. and Divine, R., "Underbalanced Drilling—Perceptions and Realities of Today's Technology in Offshore Applications," IADC/SPE 74448, pp. 1-9, (© 2002, IADC/SPE Drilling Conference).
Hannegan, Don M. and Wanzer, Glen; "Well Control Considerations—Offshore Applications of Underbalanced Drilling Technology," SPE/IADC 79854, pp. 1-14, (© 2003, SPE/IADC Drilling Conference).
Bybee, Karen, "Offshore Applications of Underbalanced-Drilling Technology," Journal of Petroleum Technology, Cover Page and pp. 51-52, (Jan. 2004).
Bourgoyne, Darryl A.; Bourgoyne, Adam T.; Hannegan, Don; "A Subsea Rotating Control Head for Riserless Drilling Applications," IADC International Deep Water Well Control Conference, pp. 1-14, (Aug. 26-27, 1998).
Lage, Antonio C.V.M; Santos, Helio; Silva, Paulo R.C.; "Drilling With Aerated Drilling Fluid From a Floating Unit Part 2: Drilling the Well," Society of Petroleum Engineers, SPE 71361, pp. 1-11, (Sep. 30-Oct. 3, 2001) (see document BBB).
Furlow, William; "Shell's seafloor pump, solids removal key to ultra-deep, dual-gradient drilling (Skid ready for commercialization)," Offshore World Trends and Technology for Offshore Oil and Gas Operations, Cover page, table of contents, pp. 54, 2 unnumbered pages, and 106, (Jun. 2001).
Rowden, Michael V.; "Advances in riserless drilling pushing the deepwater surface string envelope (Alternative to seawater, CaC12 sweeps)," Offshore World Trends and Technology for Offshore Oil and Gas Operations, Cover page, table of contents, pp. 56, 58, and 106, (Jun. 2001).
*General Catalog*, 1970-1971, Vetco Offshore, Inc., Subsea Systems; cover page, company page and numbered pp. 4800, 4816-4818; 6 pages total, in particular see numbered p. 4816 for "patented" Vetco H-4 connectors.
*General Catalog*, 1972-73, Vetco Offshore, Inc., Subsea Systems; cover page, company page and numbered pp. 4498, 4509-4510; 5 pages total.
*General Catalog*, 1974-75, Vetco Offshore, Inc.; cover page, company page and numbered pp. 5160, 5178-5179; 5 pages total.
*General Catalog*, 1976-1977, Vetco Offshore, Inc., Subsea Drilling and Completion Systems; cover page and numbered pp. 5862-5863, 5885; 4 pages total.
*General Catalog*, 1982-1983, Vetco; cover page and numbered pp. 8454-8455, 8479; 4 pages total.
*Shaffer, A Varco Company: Pressure Control While Drilling System*, http://www.tusaequip.com; printed Jun. 21, 2004; 2 pages.
*Performance Drilling by Precision Drilling. A Smart Equation*, Precision Drilling; © 2002 Precision Drilling Corporation; 12 pages, in particular see 9th page for "Northland's patented RBOP . . . "
*RPM System 3000™ Rotating Blowout Preventer: Setting a New Standard in Well Control*, Weatherford, Underbalanced Systems; © 2002-2005 Weatherford; Brochure #333.01, 4 pages.
*Managed Pressure Drilling in Marine Environments*, Don Hannegan, P.E.; Drilling Engineering Association Workshop, Moody Gardens, Galveston, Jun. 22-23, 2004; © 2004 Weatherford; 28 pages.
Hold™ 2500 RCD Rotating Control Device web page and brochure, http://www.smith.com/hold2500; printed Oct. 27, 2004; 5 pages.
Rehm, Bill, "Practical Underbalanced Drilling and Workover," Petroleum Extension Service, The University of Texas at Austin Continuing & Extended Education, cover page, title page, copyright page and pp. 6-1 to 6-9, 7-1 to 7-9 (2002).
"Pressured Mud Cap Drilling for a Semi-Submersible Drilling Rig", J.H. Terwogt, SPE, L.B. Makiaho and N. van Beelen, SPE, Shell Malaysia Exploration and Production; B.J. Gedge, SPE, and J. Jenkins, Weatherford Drilling and Well Services (6 pages total); © 2005 (This paper was prepared for presentation at the SPE/IADC Drilling Conference held in Amsterdam, The Netherlands, Feb. 23-25, 2005).
GB Search Report from Application No. GB 0324939.8 dated Jan. 21, 2004 (1 page).
MicroPatent® list of patents citing U.S. Patent No. 3,476,195, printed on Jan. 24, 2003.
PCT Search Report, International Application No. PCT/EP2004/052167, 4 pages (Date of Completion Nov. 25, 2004).
PCT Written Opinion of the International Searching Authority, International Application No. PCT/EP2004/052167, 6 pages.
Supplementary European Search Report No. EP 99908371 (date of completion Oct. 22, 2004) (3 pages).
Tangedahl, M.J., et al., "Rotating Preventers: Technology for Better Well Control," World Oil, Gulf Publishing Company, Houston, TX, US, vol. 213, No. 10, Oct. 1992, numbered pp. 63-64 and 66 (3 pages).
European Search Report for EP 05 27 0083, Application No. 05270083.8-2315, European Patent Office, Mar. 2, 2006 (5 pages).
Netherlands Search Report for NL No. 1026044, dated Dec. 14, 2005 (3 pages).
Int'l. Search Report for PCT/GB 00/00731 corresponding to U.S. :Patent No. 6,470,975 (Jun. 16, 2000) (2 pages).
GB0324939.8 Examination Report corresponding to U.S. Patent No. 6,470,975 (Mar. 21, 2006) (6 pages).
GB0324939.8 Examination Report corresponding to U.S. Patent No. 6,470,975 Jan. 22, 2004) (3 pages).
6,470,975 Family Lookup Report (Jun. 15, 2006) (5 pages).
AU S/N 28183/00 Examination Report corresponding to U.S. Patent No. 6,470,975 (1 page) (Sep. 9, 2002).
U.S. Appl. No. 60/122,530, filed Mar. 2, 1999, Priority Claimed in U.S. Patent No. 6,470,975B1.
NO S/N 20013953 Examination Report corresponding to U.S. Patent No. 6,470,975 w/one page of English translation (3 pages) (Apr. 29, 2003).
Nessa, D.O. & Tangedahl, M.L. & Saponia, J: Part 1: "Offshore underbalanced drilling system could revive field developments," World Oil, vol. 218, No. 7, Cover Page, 3, 61-64 and 66 (Jul. 1997); and Part 2: "Making this valuable reservoir drilling/completion technique work on a conventional offshore drilling platform." World Oil, vol. 218 No. 10, Cover Page, 3, 83, 84, 86 and 88 (Oct. 1997) (see 5A, 5G above and 5I below).
Int'l. Search Report for PCT/GB 00/00731 corresponding to U.S. Patent No. 6,470,975 (4 pages) (Jun. 27, 2000).
Int'l. Preliminary Examination Report for PCT/GB 00/00731 corresponding to U.S. Patent No. 6,470,975 (7 pages) (Dec. 14, 2000).
NL Examination Report for WO 00/52299 corresponding to this U.S. Appl. No. 10/281,534 (3 pages) (Dec. 19, 2003).
AU S/N 28181/00 Examination Report corresponding to U.S. Patent No. 6,263,982 (1 page) (Sep. 6, 2002).
EU Examination Report for WO 00/906522.8-2315 corresponding to U.S. Patent No. 6,263,982 (4 pages) (Nov. 29, 2004).
NO S/N 20013952 Examination Report w/two pages of English translation corresponding to U.S. Patent No. 6,263,982 (4 pages) (Jul. 2, 2005).
PCT/GB00/00726 Int'l. Preliminary Examination Report corresponding to U.S. Patent No. 6,263,982 (10 pages) (Jun. 26, 2001).
PCT/GB00/00726 Written Opinion corresponding to U.S. Patent No. 6,263,982 (7 pages) (Dec. 18, 2000).
PCT/GB00/00726 International Search Report corresponding to U.S. Patent No. 6,263,982, (3 pages (Mar. 2, 1999).
AU S/N 27822/99 Examination Report corresponding to U.S. Patent No. 6,138,774 (1 page) (Oct. 15, 2001).

EU 99908371.0-1266-US9903888 European Search Report corresponding to U.S. Patent No. 6,138,774 (3 pages) (Nov. 2, 2004).
NO S/N 20003950 Examination Report w/one page of English translation corresponding to U.S. Patent No. 6,138,774 (3 pages) (Nov. 1, 2004).
PCT/US990/03888 Notice of Transmittal of International Search Report corresponding to U.S. Patent No. 6,138,774 (6 pages) (Aug. 4, 1999).
PCT/US99/03888 Written Opinion corresponding to U.S. Patent No. 6,138,744 (5 pages) (Dec. 21, 1999).
PCT/US99/03888 Notice of Transmittal of International Preliminary Examination Report corresponding to U.S. Patent No. 6,138,774 (15 pages) (Jun. 12, 2000).
EU Examination Report for 05270083.8-2315 corresponding to US 2006/0108119 A1 published May 25, 2006 (11 pages) (May 10, 2006).
Tangedahl, M.J., et al. "Rotating Preventers: Technology for Better Well Control," World Oil, Gulf Publishing Company, Houston, TX, US, vol. 213, No. 10, Oct. 1992, numbered pp. 63-64 and 66 (3 pages) XP 000288328 ISSN: 0043-8790 (see YYYY, 5X above).
UK Search Report for Application No. GB 0325423.2, search Jan. 30, 2004 corresponding to above U.S. Patent No. 7,040,394 (one page).
UK Examination Report for Application No. GB 0325423.2 (corresponding to above 5Z) (4 pages).

METHOD FOR PRESSURIZED MUD CAP AND REVERSE CIRCULATION DRILLING FROM A FLOATING DRILLING RIG USING A SEALED MARINE RISER

BACKGROUND OF THE INVENTION

1. Field of the Invention

The present invention relates to a method for pressurized mud cap and reverse circulation drilling from a floating structure using a sealed marine riser while drilling. In particular, the present invention relates to a method for pressurized mud cap and reverse circulation drilling from a floating structure while drilling in the floor of an ocean using a rotating control head.

2. Description of the Related Art

Marine risers extending from a wellhead fixed on the floor of an ocean have been used to circulate drilling fluid back to a floating structure or rig. The riser must be large enough in internal diameter to accommodate the largest bit and pipe that will be used in drilling a borehole into the floor of the ocean. Conventional risers now have internal diameters of approximately 20 inches, though other diameters are and can be used.

An example of a marine riser and some of the associated drilling components, such as shown in FIG. 1, is proposed in U.S. Pat. No. 4,626,135, assigned on its face to Hydril Company, which is incorporated herein by reference for all purposes. Since the riser R is fixedly connected between the floating structure or rig S and the wellhead W, as proposed in the '135 patent, a conventional slip or telescopic joint SJ, comprising an outer barrel OB and an inner barrel IB with a pressure seal therebetween, is used to compensate for the relative vertical movement or heave between the floating rig and the fixed riser. Diverters D have been connected between the top inner barrel IB of the slip joint SJ and the floating structure or rig S to control gas accumulations in the subsea riser R or low pressure formation gas from venting to the rig floor F.

One proposed diverter system is the TYPE KFDS diverter system, previously available from Hughes Offshore, a division of Hughes Tool Company, for use with a floating rig. The KFDS system's support housing SH, shown in FIG. 1A, is proposed to be permanently attached to the vertical rotary beams B between two levels of the rig and to have a full opening to the rotary table RT on the level above the support housing SH. A conventional rotary table on a floating drilling rig is approximately 49½ inches in diameter. The entire riser, including an integral choke line CL and kill line KL, are proposed to be run-through the KFDS support housing. The support housing SH is proposed to provide a landing seat and lockdown for a diverter D, such as a REGAN diverter also supplied by Hughes Offshore. The diverter D includes a rigid diverter lines DL extending radially outwardly from the side of the diverter housing to communicate drilling fluid or mud from the riser R to a choke manifold CM, shale shaker SS or other drilling fluid receiving device. Above the diverter D is the rigid flowline RF, shown configured to communicate with the mud pit MP in FIG. 1, the rigid flowline RF has been configured to discharge into the shale shakers SS or other desired fluid receiving devices. If the drilling fluid is open to atmospheric pressure at the bell-nipple in the rig floor F, the desired drilling fluid receiving device must be limited by an equal height or level on the structure S or, if desired, pumped by a pump up to a higher level. While the choke manifold CM, separator MB, shale shaker SS and mud pits MP are shown schematically in FIG. 1, if a bell-nipple is at the rig floor F level and the mud return system is under minimal operating pressure, these fluid receiving devices may have to be located at a level below the rig floor F for proper operation. Hughes Offshore has also provided a ball joint BJ between the diverter D and the riser R to compensate for other relative movement (horizontal and rotational) or pitch and roll of the floating structure S and the fixed riser R.

Because both the slip joint and the ball joint require the use of sliding pressure seals, these joints need to be monitored for proper seal pressure and wear. If the joints need replacement, significant rig downtime can be expected. In addition, the seal pressure rating for these joints may be exceeded by emerging and existing drilling techniques that require surface pressure in the riser mud return system, such as in underbalanced operations comprising drilling, completions and workovers, gas-liquid mud systems and pressurized mud handling systems. Both the open bell-nipple and seals in the slip and ball joints create environmental issues of potential leaks of fluid.

Returning to FIG. 1, the conventional flexible choke line CL has been configured to communicate with a choke manifold CM. The drilling fluid then can flow from the manifold CM to a mud-gas buster or separator MB and a flare line (not shown). The drilling fluid can then be discharged to a shale shaker SS to mud pits and pumps MP. In addition to a choke line CL and kill line KL, a booster line BL can be used. An example of some of the flexible conduits now being used with floating rigs are cement lines, vibrator lines, choke and kill lines, test lines, rotary lines and acid lines.

The following patents and published patent applications, assigned to assignee of the present invention, Weatherford/Lamb, Inc., propose floating rig systems and methods, and are incorporated herein by reference in their entirety for all purposes: U.S. Pat. No. 6,263,982, entitled "Method and system for return of drilling fluid from a sealed marine riser to a floating drilling rig while drilling"; U.S. Pat. No. 6,470,975, entitled "Internal riser rotating control head"; U.S. Pat. No. 6,138,774, entitled "Method and apparatus for drilling a borehole into a subsea abnormal pore pressure environment"; U.S. Patent Application Publication No. 20030106712, entitled "Internal riser rotating control head"; and U.S. Patent Application Publication No. 20010040052, entitled "Method and system for return of drilling fluid from a sealed marine riser to a floating drilling rig while drilling."

The '982 patent proposes a floating rig mud return system that replaces the use of the conventional slip and ball joints, diverter and bell-nipple with a seal below the rig floor between the riser and rotating tubular. More particularly, the '982 patent proposes to have a seal housing, that is independent of the floating rig or structure for receiving the rotatable tubular, with a flexible conduit or flowline from the seal housing to the floating structure to compensate for resulting relative movement of the structure and the seal housing. Furthermore, the '982 patent proposes the seal between the riser and the rotating tubular would be accessible for ease in inspection, maintenance and for quick change-out.

In addition, it has been known in onshore drilling to use a mud cap for increasing bottomhole pressure. A mud cap, which is a column of heavy and often viscosified mud in the annulus of the well, has a column shorter than the total vertical depth (TVD) of the annulus. A mud cap can typically be used to control bottomhole pressure on a trip and to keep gas or liquid from coming to the surface in a well, resulting in total lost circulation. The size of the mud cap is based on, among other factors, how long the cap needs to be, the mud weight of the cap, and the amount of extra pressure that is needed to balance or control the well.

When a single pass drilling fluid is used, the mud cap can also prohibit fluid and cuttings from returning from downhole. Rather, the mud cap in the annulus directs mud and cuttings into a zone of high porosity lost circulation, sometimes known as a theft zone. While a theft zone, when drilling conventionally, can cause undesirable excessive or total lost circulation, differentially stuck pipe, and resulting well control issues, mud cap drilling takes advantage of the presence of a theft zone. Because the theft zone is of high porosity, relatively depleted, and above the production zone, the theft zone offers an ideal depository for clear, non-evasive fluids and cuttings. In one mud cap drilling technique, pressurized mud cap drilling (PMCD), well bore pressure management is achieved by pump rates. One further requirement of a mud cap concerns the resistance of the mud to contamination in the well bore, its viscosity, and its resistance to being broken up by flow or circulation, which depend on the purpose of the mud cap, the size of the hole, the mud in the hole, and the formation fluid. Mud from a mud cap used on a trip is generally stored and reused on the next trip.

FIG. 13 is an elevational view showing a prior art onshore well 1300 using mud cap drilling. A mud cap 1330 is placed in the annulus 1350 surrounding the drill pipe 1320, capping the return flow from the borehole 1360 upwards through the annulus 1350. Cuttings and debris are shown extending outward from the borehole into a lost circulation area 1340. This mud cap drilling technique is well known for onshore wells and offshore fixed wells, but has been unavailable for offshore floating rigs because of the inability to handle the vertical and horizontal movements of the floating rig structure relative to the annulus, while sealing the top of the riser.

Although PMCD has been used in onshore drilling, PMCD has been unavailable for use offshore on floating rigs, such as semi-submersible rigs. The ability to use PMCD offshore on floating rigs would be desirable.

BRIEF SUMMARY OF THE INVENTION

A method for pressurized mud cap and reverse circulation drilling is disclosed for use with a floating rig or structure. A seal housing having a rotatable seal is connected to the top of a marine riser fixed to the floor of the ocean. The seal housing includes a first housing opening sized to pump drilling fluid down the annulus of the riser. In the mud cap drilling embodiment, the drilling fluid forms a mud cap at a downhole location of the riser. In the reverse circulation drilling embodiment, the drilling fluid flows down the riser and returns up the rotatable tubular to the floating structure. The seal rotating with the rotatable tubular allows the riser and seal housing to maintain a predetermined pressure in the drilling fluid that is desirable in both of those drilling embodiments. A flexible conduit or hose is used to compensate for the relative movement between the seal housing and the floating structure since the floating structure moves independent of the seal housing.

BRIEF DESCRIPTION OF THE SEVERAL VIEWS OF THE DRAWINGS

A better understanding of the present invention can be obtained when the following detailed description of the preferred embodiment is considered in conjunction with the following drawings, in which.

DETAILED DESCRIPTION OF THE INVENTION

Figure 14:
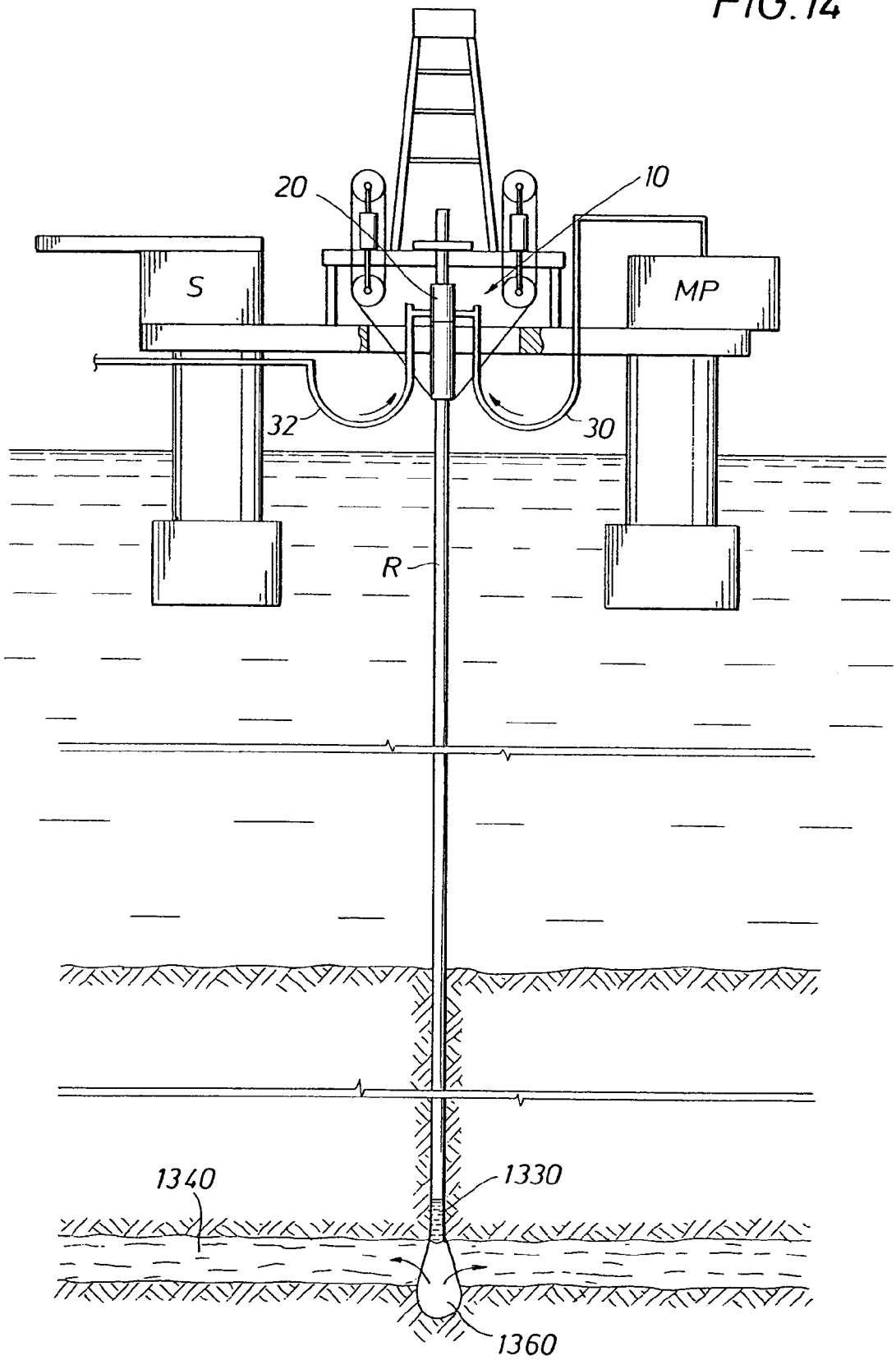
FIG. 14 is an elevational view of an exemplary floating rig better illustrating the PMCD or mud cap drilling embodiment.

FIG. 14 discloses the preferred embodiment of the present invention.

Figure 2:
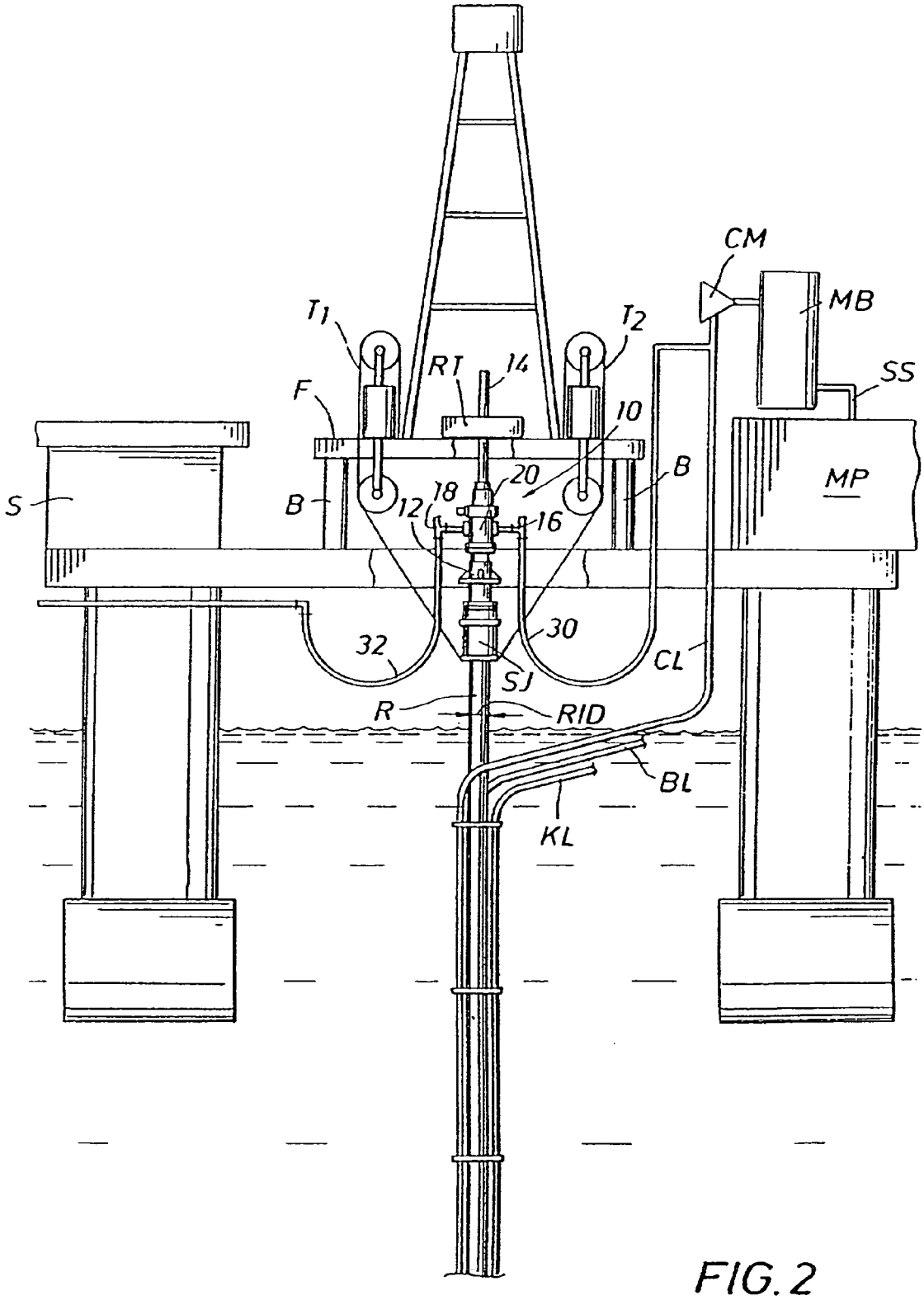
FIG. 2 is an enlarged elevational view of the floating rig system according to one embodiment.
Figure 3:
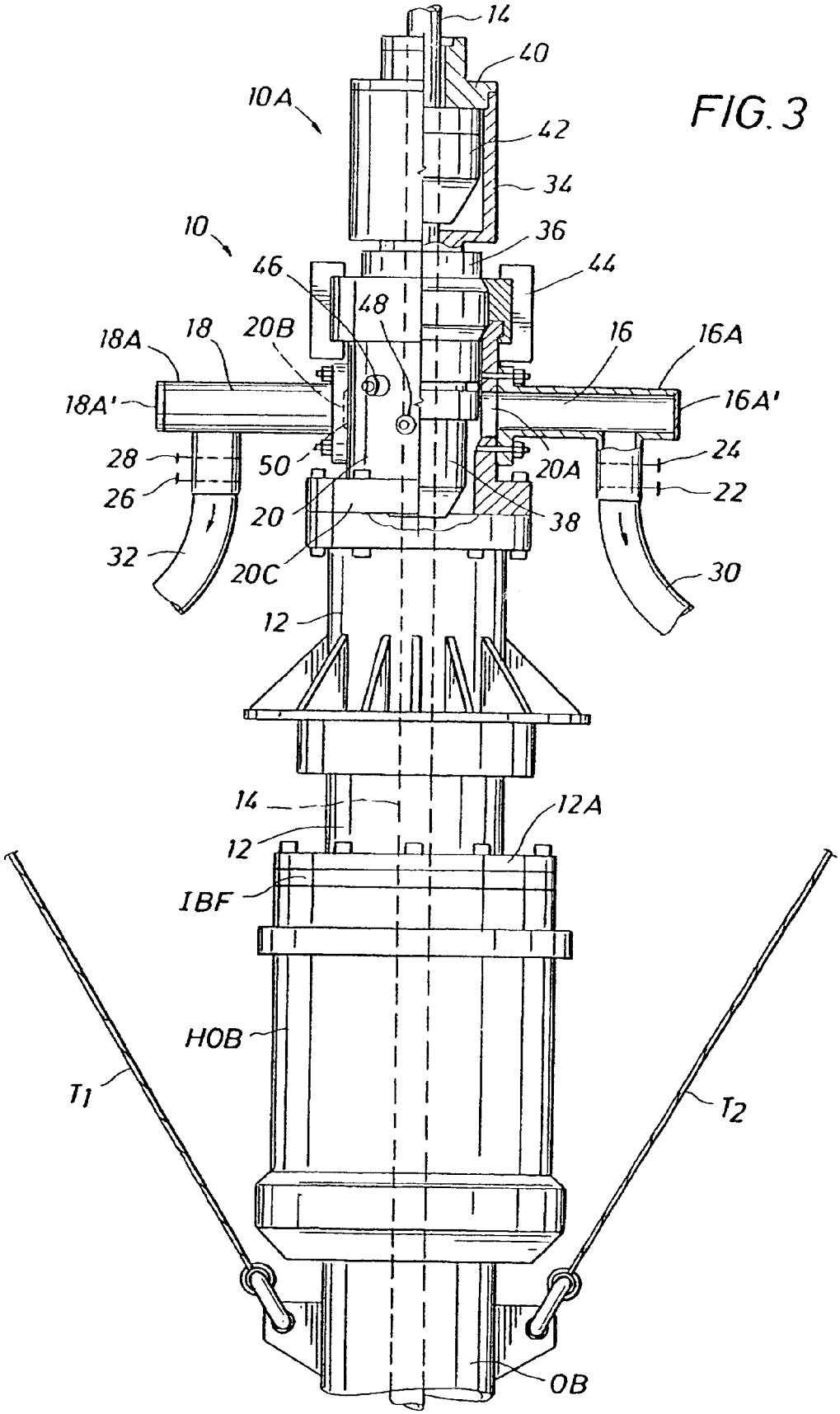
FIG. 3 is an enlarged view of the seal housing of the one embodiment positioned above the riser with the rotatable seal in the seal housing engaging a rotatable tubular.

FIG. 2 illustrates a rotating control head (RCH), generally designated as 10, of the present invention. The RCH 10 is similar, except for modifications discussed below, to the RCH disclosed in U.S. Pat. No. 5,662,181, entitled "Rotating Blowout Preventer" and assigned to the assignee of the present invention, Weatherford/Lamb, Inc. of Houston, Tex. The '181 patent, incorporated herein by reference for all purposes, discloses a product now available from the assignee that is designated Model 7100. The modified RCH 10 can be attached above the riser R, when the slip joint SJ is locked into place, such as shown in the embodiment of FIG. 2, so that there is no relative vertical movement between the inner barrel IB and outer barrel DB of the slip joint SJ. It is contemplated that the slip joint SJ can be removed from the riser R and the RCH 10 attached directly to the riser R. In either embodiment of a locked slip joint (FIG. 2) or no slip joint (not shown), an adapter or crossover 12 will be positioned between the RCH 10 and the slip joint SJ or directly to the riser R, respectively. As is known, conventional tensioners T1 and T2 will be used for applying tension to the riser R. As can be seen in FIGS. 2 and 3, a rotatable tubular 14 is positioned through the rotary table RT, through the rig floor F, through the RCH 10 and into the riser R for drilling in the floor of the ocean. In addition to using the BOP stack as a complement to the RCH 10, a large diameter valve could be placed below the RCH 10. When no tubulars are inside the riser R, this valve could be closed and the riser could be circulated with the booster line BL. Additionally, a gas handler, such as proposed in the Hydril '135 patent, could be used as a backup to the RCH 10. For example, if the RCH 10 developed a leak while under pressure, the gas handler could be closed and the RCH 10 seal(s) replaced.

Target T-connectors 16 and 18 preferably extend radially outwardly from the side of the seal housing 20. As best shown in FIG. 3, the T-connectors 16, 18 comprise terminal T-portions 16A and 18A, respectively, which reduce erosion caused by fluid discharged from the seal housing 20. Each of these T-connectors 16, 18 preferably include a lead "target" plate in the terminal T-portions 16A and 18A to receive the pressurized drilling fluid flowing from the seal housing 20 to the connectors 16 and 18. Although T-connectors are shown in FIG. 3, other types of erosion-resistant connectors can be used, such as long radius 90-degree elbows or tubular fittings. Additionally, a remotely operable valve 22 and a manual valve 24 are provided with the connector 16 for closing the connector 16 to shut off the flow of fluid, when desired. Remotely operable valve 26 and manual valve 28 are similarly provided in connector 18. As shown in FIGS. 2 and 3, a conduit 30 is connected to the connector 16 for communicating the drilling fluid from the first housing opening 20A to a fluid receiving device on the structure S. The conduit 30 communicates fluid to a choke manifold CM in the configuration of FIG. 2. Similarly, conduit 32, attached to connector 18, though shown discharging into atmosphere could be discharged to the choke manifold CM or directly to a separator MB or shale shaker SS. It is to be understood that the conduits 30, 32 can be a elastomer hose; a rubber hose reinforced with steel; a flexible steel pipe such as manufactured by Coflexip International of France, under the trademark "COFLEXIP", such as their 5" internal diameter flexible pipe; or shorter segments of rigid pipe connected by flexible joints and other flexible conduit known to those of skill in the art.

Turning now to FIG. 3, the RCH 10 is shown in more detail and in section view to better illustrate the bearing and seal assembly 10A. In particular, the bearing and seal assembly 10A comprises a top rubber pot 34 connected to the bearing assembly 36, which is in turn connected to the bottom stripper rubber 38. The top drive 40 above the top stripper rubber 42 is also a component of the bearing and seal assembly 10A. Although, as shown in FIG. 3, the bearing and seal assembly 10A uses stripper rubber seals 38 and 42, other types of seals can be used. Stripper rubber seals, as shown in FIG. 3, are examples of passive seals, in that they are stretch-fit and cone shape vector forces augment a closing force of the seal around the rotatable tubular 14. In addition to passive seals, active seals can be used. Active seals typically require a remote-to-the-tool source of hydraulic or other energy to open or close the seal. An active seal can be remotely deactivated when desired to reduce or eliminate sealing forces with the tubular 14. Additionally, when deactivated, an active seal allows annulus fluid continuity up to the top of the RCH 10. One example of an active seal is an inflatable seal. The RPM SYSTEM 3000™ from TechCorp Industries International Inc. and the Seal-Tech Rotating Blowout Preventer from Seal-Tech are two examples that use a hydraulically operated active seal. U.S. Pat. Nos. 5,022,472, 5,178,215, 5,224,557, 5,277,249 and 5,279,365 also disclose active seals and are incorporated herein by reference for all purposes. Other types of active seals are also contemplated for use. A combination of active and passive seals can also be used.

It is also contemplated that a control device, such as disclosed in U.S. Pat. No. 5,178,215, could be adapted for use with its rotary packer assembly rotatably connected to and encased within the outer housing.

Figure 5:
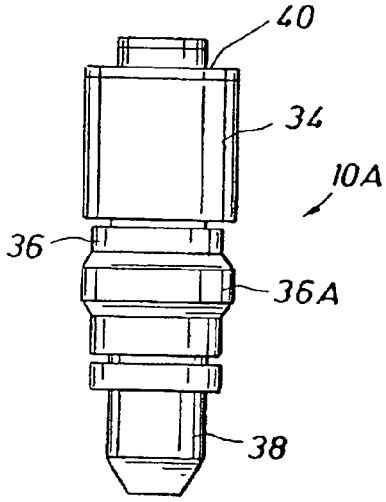
FIG. 5 is the bearing and seal assembly of one embodiment removed from the seal housing.

Additionally, a quick disconnect/connect clamp 44, as disclosed in the '181 patent, is provided for hydraulically clamping, via remote controls, the bearing and seal assembly 10A to the seal housing or bowl 20. As discussed in more detail in the '181 patent, when the rotatable tubular 14 is tripped out of the RCH 10, the clamp 44 can be quickly disengaged to allow removal of the bearing and seal assembly 10A, as best shown in FIG. 5.

Figure 4:
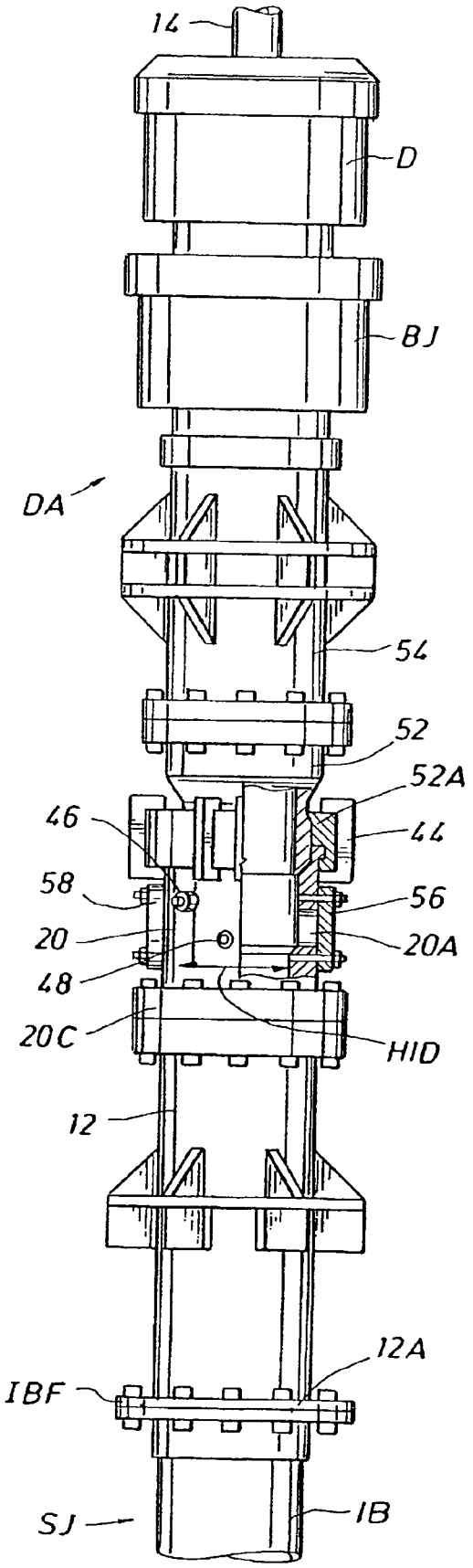
FIG. 4 is an elevational view of a diverter assembly substituted for a bearing and seal assembly in the seal housing of one embodiment for conventional use of a diverter and slip and ball joints with the riser.

Advantageously, upon removal of the bearing and seal assembly 10A, as shown in FIG. 4, the internal diameter HID of the seal housing 20 is substantially the same as the internal diameter RID of the riser R, as indicated in FIG. 2, to provide a substantially full-bore access to the riser R.

Alternately, although not shown in FIG. 3, a suspension or carrier ring can be used with the RCH 10. The carrier ring can modify the internal diameter HID of the seal housing 20 to adjust it to the internal diameter RID of the riser, allowing full-bore passage when installed on top of a riser with an internal diameter RID different from the internal diameter HID of the seal housing 20. The carrier ring preferably can be left attached to the bearing and seal assembly 10A when removed for maintenance to reduce replacement time, or can be detached and reattached when replacing the bearing and seal assembly 10A with a replacement bearing and seal assembly 10A.

Returning again to FIG. 3, while the RCH 10 of the present invention is similar to the RCH described in the '181 patent, the housing or bowl 20 includes first and second housing openings 20A, 20B opening to their respective connector 16, 18. The housing 20 further includes four holes, two of which 46, 48 are shown in FIGS. 3 and 4, for receiving latching pins and locating pins, as will be discussed below in detail. In the additional second opening 20B, a rupture disk 50 is preferably engineered to rupture at a predetermined pressure less than the maximum allowable pressure capability of the marine riser R. In one embodiment, the rupture disk 50 ruptures at approximately 500 PSI. In another embodiment, the maximum pressure capability of the riser R is 500 PSI and the rupture disk 50 is configured to rupture at 400 PSI. If desired by the user, the two openings 20A and 20B in seal housing 20 can be used as redundant means for conveying drilling fluid during normal operation of the device without a rupture disk 50. If these openings 20A and 20B are used in this manner, connector 18 would desirably include a rupture disk configured to rupture at the predetermined pressure less than a maximum allowable pressure capability of the marine riser R. The seal housing 20 is preferably attached to an adapter or crossover 12 that is available from ABB Vetco Gray. The adapter 12 is connected between the seal housing flange 20C and the top of the inner barrel IB. When using the RCH 10, as shown in FIG. 3, movement of the inner barrel IB of the slip joint SJ is locked with respect to the outer barrel OB and the inner barrel flange IBF is connected to the adapter bottom flange 12A. In other words, the head of the outer barrel HOB, that contains the seal between the inner barrel 18 and the outer barrel OB, stays fixed relative to the adapter 12.

Turning now to FIG. 4, an embodiment is shown where the adapter 12 is connected between the seal housing 20 and an operational or unlocked inner barrel IB of the slip joint SJ. In this embodiment, the bearing and seal assembly 10A, as such as shown in FIG. 5, is removed after using the quick disconnect/connect clamp 44. If desired the connectors 16, 18 and the conduits 30, 32, respectively, can remain connected to the housing 20 or the operator can choose to use a blind flange 56, as shown in FIG. 4, to cover the first housing opening 20A and/or a blind flange 58 to cover the second housing opening 20B. If the connectors 16, 18 and conduits 30, 32, respectively, are not removed the valves 22 and 24 on connector 16 and, even though the rupture disk 50 is in place, the valves 26 and 28 on connector 18 are closed. Another modification to the seal housing 20 from the housing shown in the '181 patent is the use of studded adapter flanges instead of a flange accepting stud bolts, since studded flanges require less clearance for lowering the housing through the rotary table RT.

Figure 1:
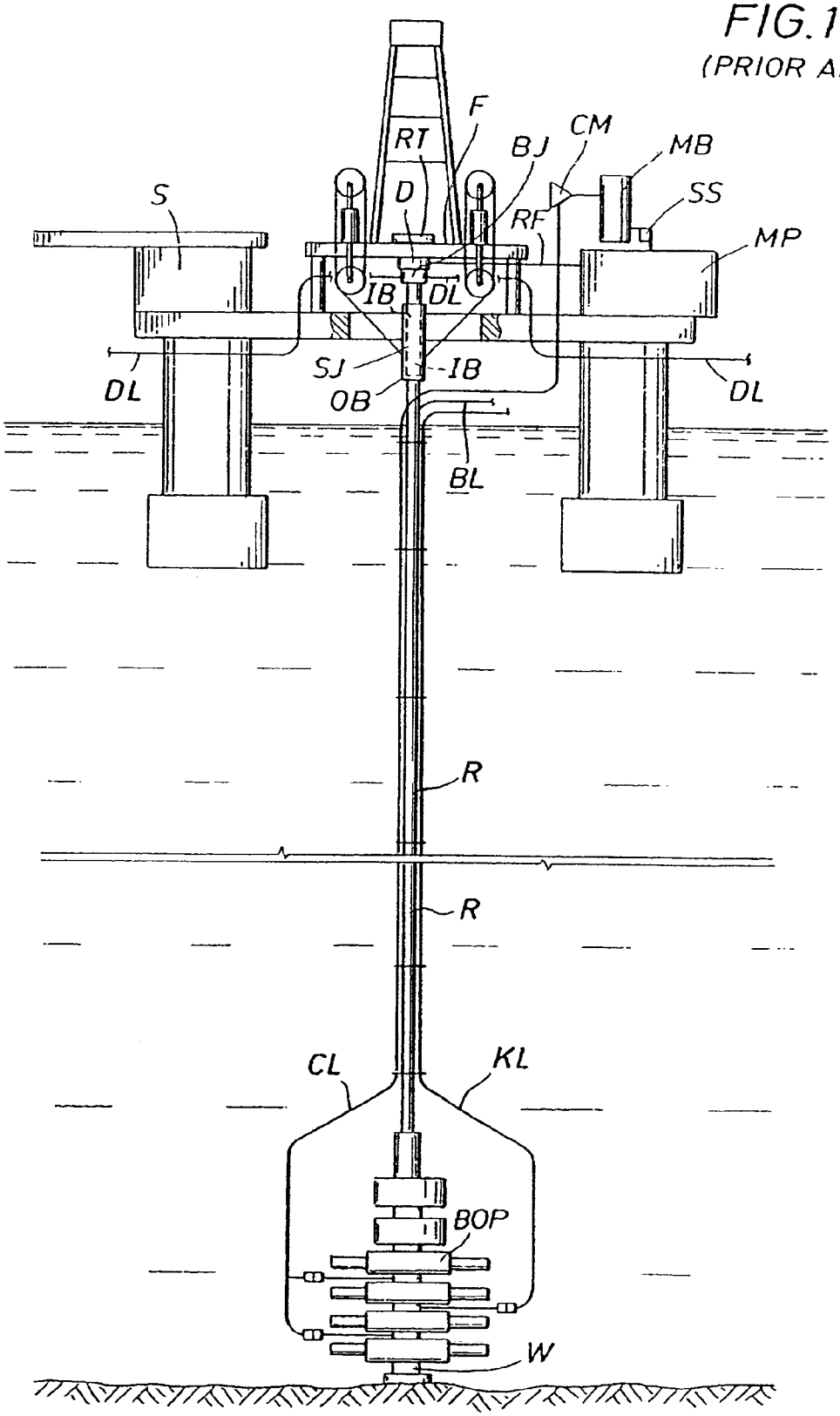
FIG. 1 (PRIOR ART)
FIG. 1 is an elevational view of a prior art floating rig mud return system shown in broken view with the lower portion illustrating the conventional subsea blowout preventer stack attached to a wellhead and the upper portion illustrating the conventional floating rig where a riser is connected to the floating rig and conventional slip and ball joints and diverters are used.
Figure 1A:
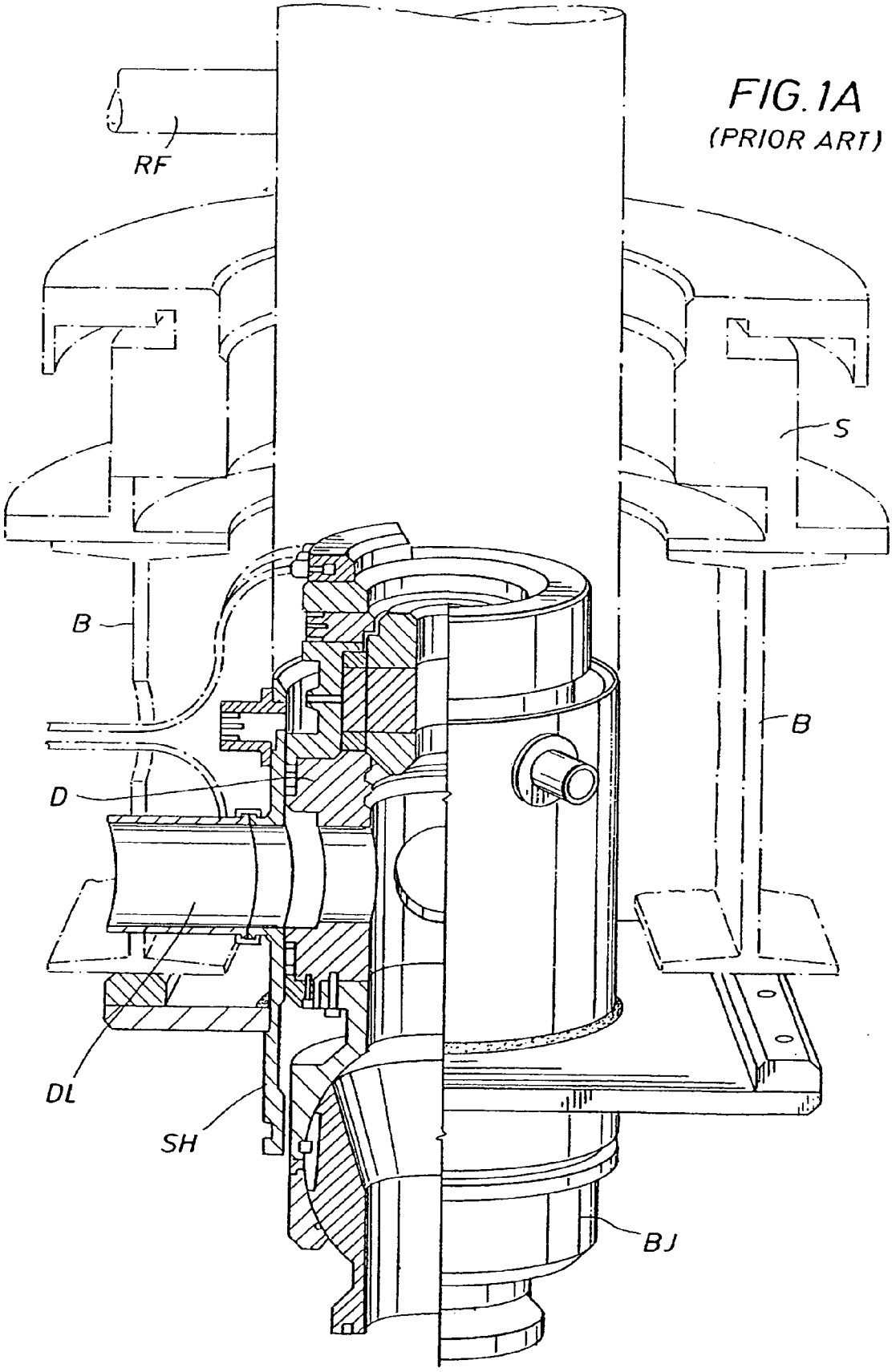
FIG. 1A (PRIOR ART)
FIG. 1A is an enlarged elevational view of a prior art diverter support housing for use with a floating rig.

Continuing to view FIG. 4, an adapter 52, having an outer collar 52A similar to the outer barrel collar 36A of outer barrel 36 of the bearing and seal assembly 10A, as shown in FIG. 5, is connected to the seal housing 20 by clamp 44. A diverter assembly DA comprising diverter D, ball joint BJ, crossover 54 and adapter 52 are attached to the seal housing 20 with the quick connect clamp 44. As discussed in detail below, the diverter assembly DA, seal housing 20, adapter 12 and inner barrel IB can be lifted so that the diverter D is directly connected to the floating structure S, similar to the diverter D shown in FIG. 1A, but without the support housing SH.

As can now be understood, in the embodiment of FIG. 4, the seal housing 20 will be at a higher elevation than the seal housing 20 in the embodiment of FIG. 2, since the inner barrel IB has been extended upwardly from the outer barrel OB. Therefore, in the embodiment of FIG. 4, the seal housing 20 would not move independent of the structure S but, as in the conventional mud return system, would move with the structure S with the relative movement being compensated for by the slip and ball joints.

Figure 6:
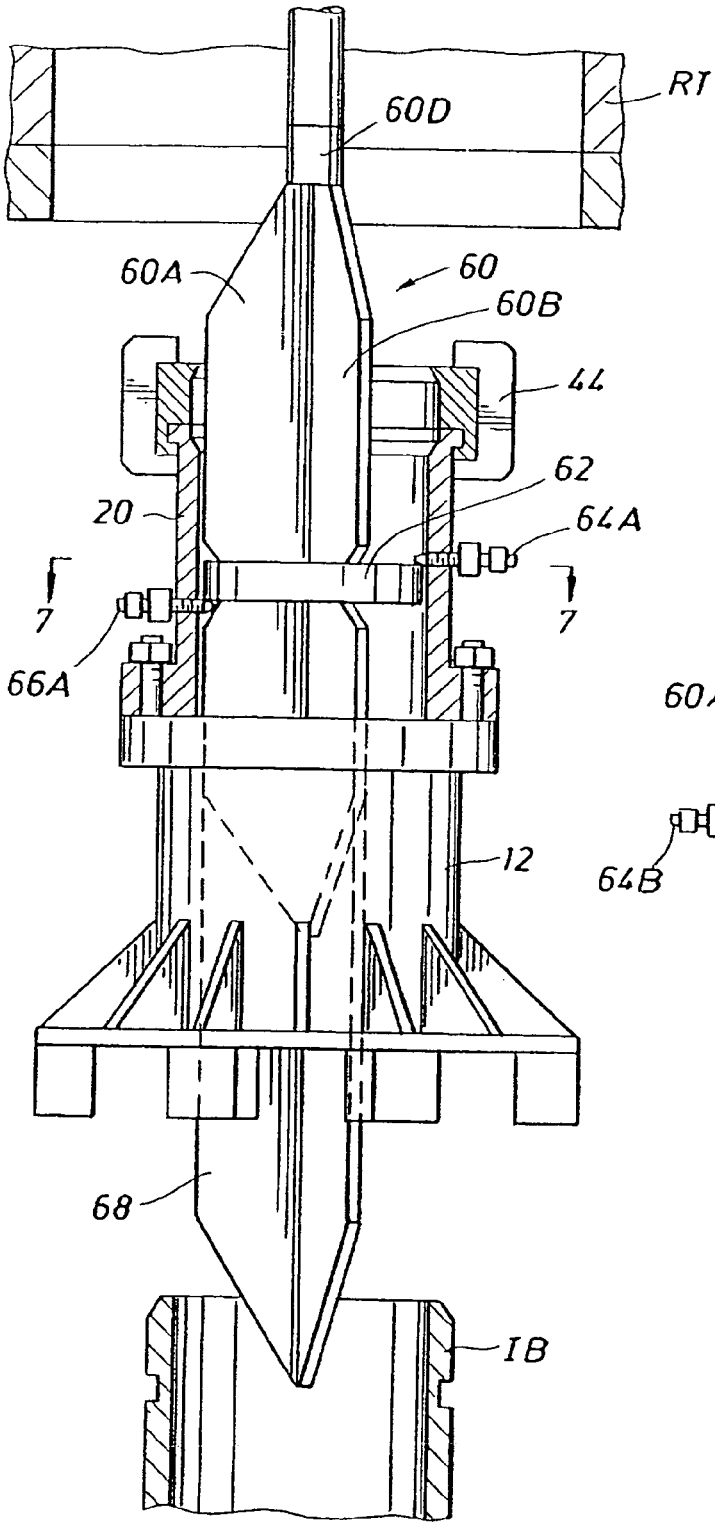
FIG. 6 is an elevational view of an internal running tool and riser guide with the running tool engaging the seal housing of one embodiment.
Figure 7:
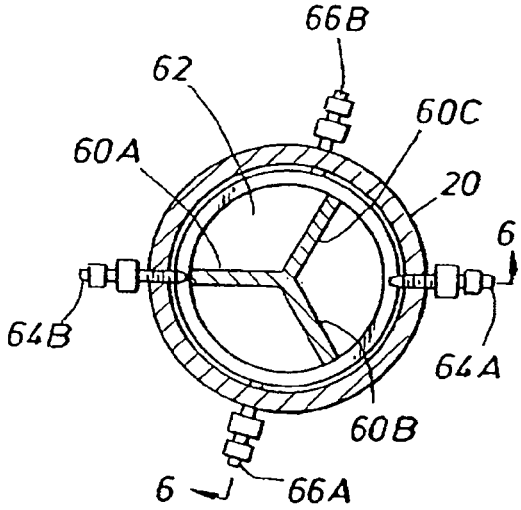
FIG. 7 is a section view taken along lines 7-7 of FIG. 6.
Figure 8:
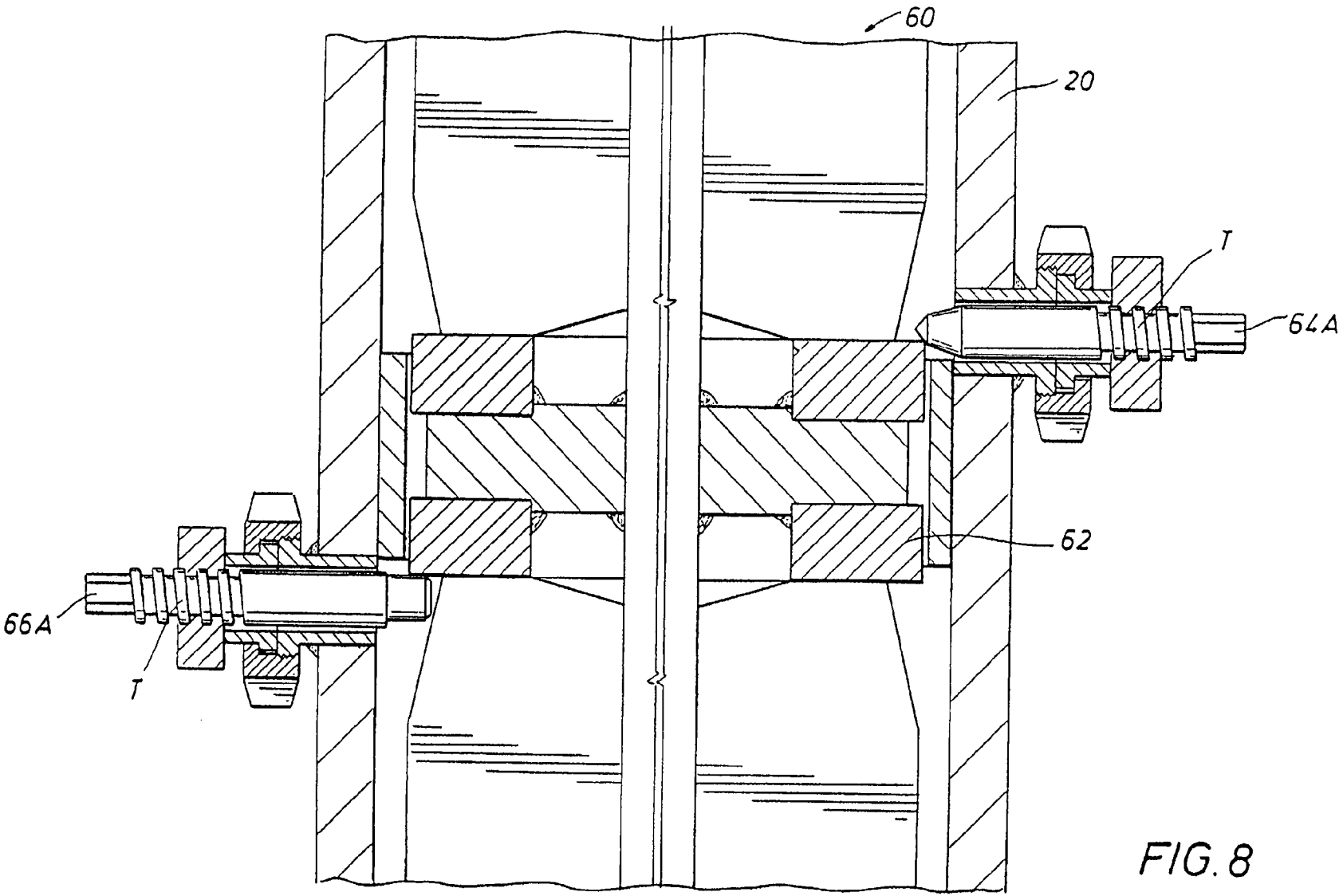
FIG. 8 is an enlarged elevational view of the seal housing shown in section view to better illustrate the locating pins and latching pins relative to the load disk of one embodiment.
Figure 9:
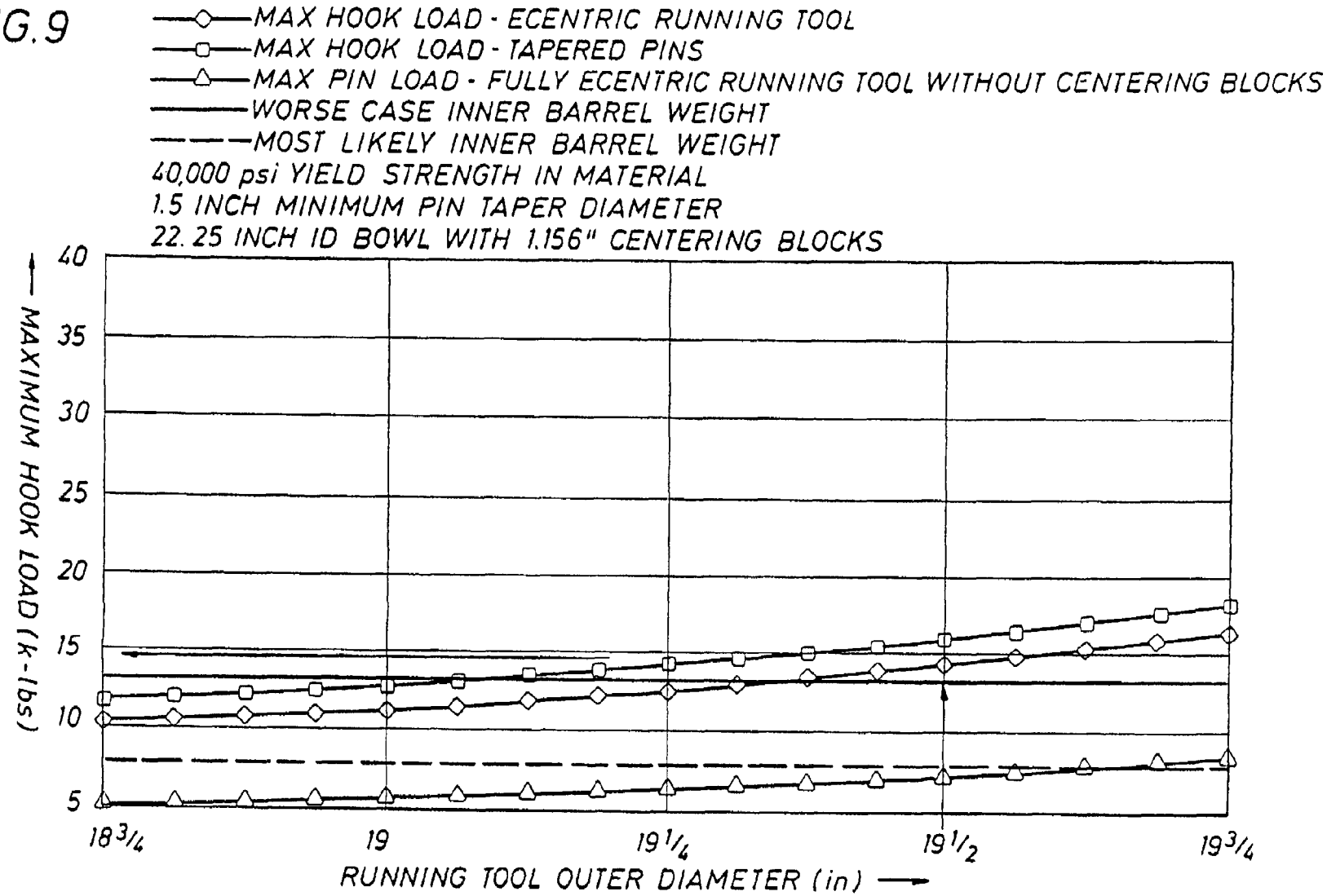
FIG. 9 is a graph illustrating latching pin design curves for latching pins fabricated from mild steel.
Figure 10:
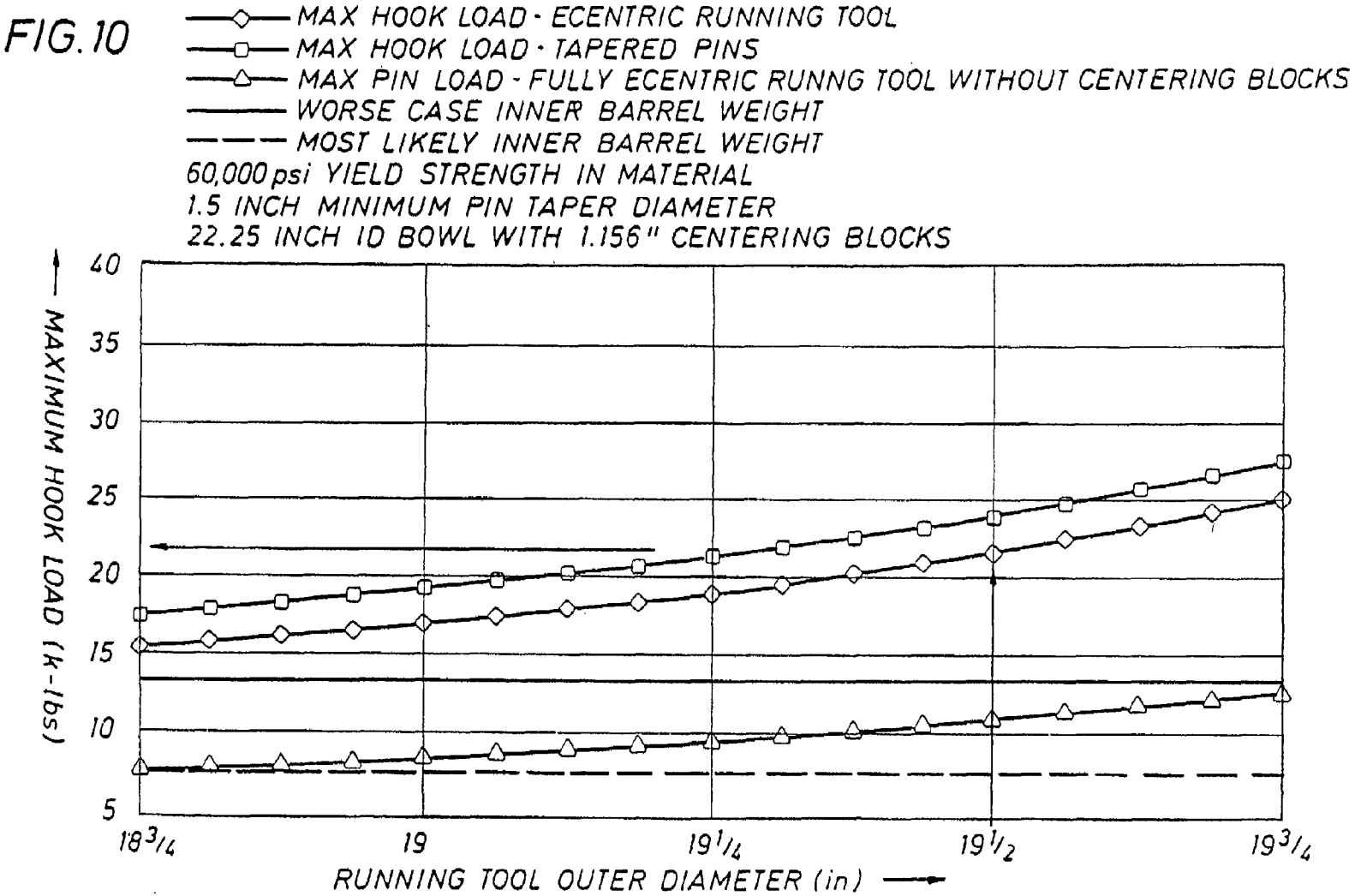
FIG. 10 is a graph illustrating latching pin design curves for latching pins fabricated from 4140 steel.

Turning now to FIG. 6, an internal running tool 60 includes three centering pins 60A, 60B, 60C equally spaced apart 120 degrees. The tool 60 preferably has a 19.5" outer diameter and a 4½" threaded box connection 60D on top. A load disk or ring 62 is provided on the tool 60. As best shown in FIGS. 6 and 7, latching pins 64A, 64B and locating pins 66A, 66B preferably include extraction threads T cut into the pins to provide a means of extracting the pins with a 1⅛" hammer wrench in case the pins are bent due to operator error. The latching pins 64A, 64B can be fabricated from mild steel, such as shown in FIG. 9, or 4140 steel case, such as shown in FIG. 10. A detachable riser guide 68 is preferably used with the tool 60 for connection alignment during field installation, as discussed below.

Figure 11:
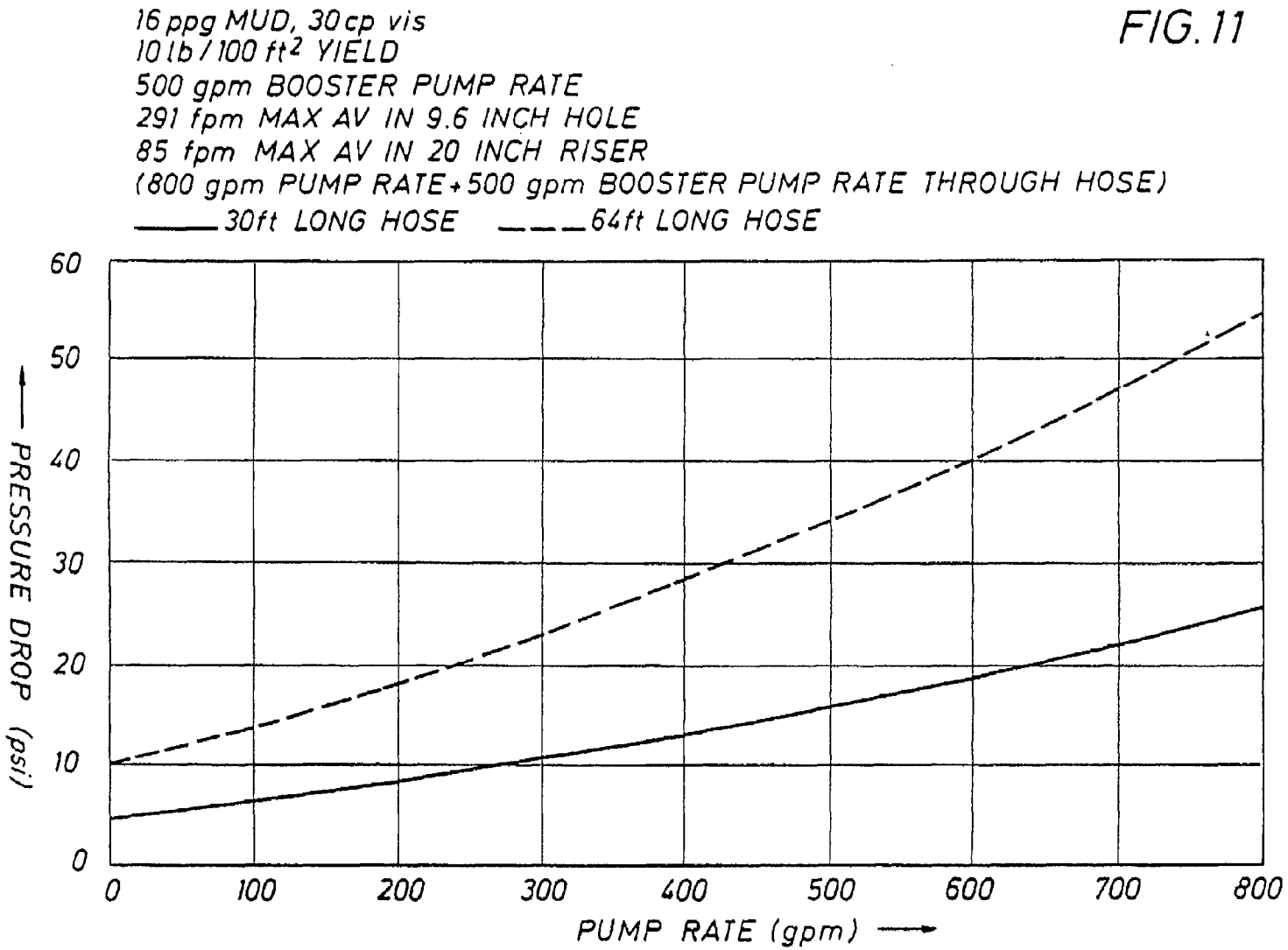
FIG. 11 is a graph illustrating estimated pressure losses in a 4-inch diameter hose.
Figure 12:
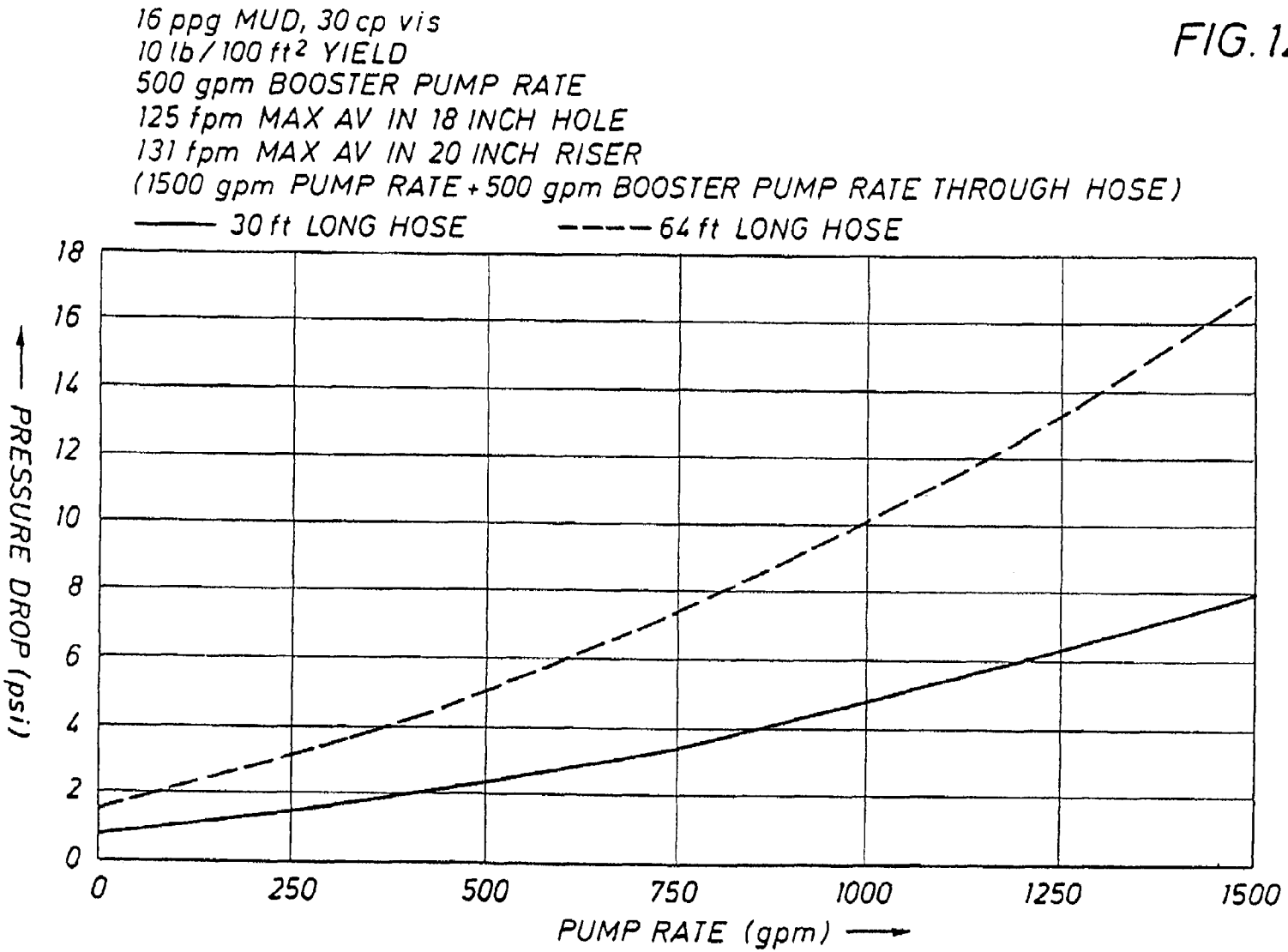
FIG. 12 is a graph illustrating estimated pressure losses in a 6-inch diameter hose.

The conduits 30, 32 are preferably controlled with the use of snub and chain connections (not shown), where the conduit 30, 32 is connected by chains along desired lengths of the conduit to adjacent surfaces of the structure S. Of course, since the seal housing 20 will be at a higher elevation when in a conventional slip joint/diverter configuration, such as shown in FIG. 4, a much longer hose is required if a conduit remains connected to the housing 20. While a 6" diameter conduit or hose is preferred, other size hoses such as a 4" diameter hose could be used, such as discussed in FIGS. 11 and 12.

Operation of Use

After the riser R is fixed to the wellhead W, the blowout preventer stack BOP (FIG. 1) positioned, the flexible choke line CL and kill line KL are connected, the riser tensioners T1, T2 are connected to the outer barrel OB of the slip joint SJ, as is known by those skilled in the art, the inner barrel IB of the slip joint SJ is pulled upwardly through a conventional rotary table RT using the running tool 60 removable positioned and attached to the housing 20 using the latching and locating pins, as shown in FIGS. 6 and 7. The seal housing 20 attached to the crossover or adapter 12, as shown in FIGS. 6 and 7, is then attached to the top of the inner barrel IB. The clamp 44 is then removed from the housing 20. The connected housing 20 and crossover 12 are then lowered through the rotary table RT using the running tool 60. The riser guide 68 detachable with the tool 60 is fabricated to improve connection alignment during field installation. The detachable riser guide 68 can also be used to deploy the housing 20 without passing it through the rotary table RT. The bearing and seal assembly 10A is then installed in the housing 20 and the rotatable tubular 14 installed.

If configuration of the embodiment of FIG. 4 is desired, after the tubular 14 has been tripped and the bearing and seal assembly removed, the running tool 60 can be used to latch the seal housing 20 and then extend the unlocked slip joint SJ. The diverter assembly DA, as shown in FIG. 4, can then be received in the seal housing 20 and the diverter assembly adapter 52 latched with the quick connect clamp 44. The diverter D is then raised and attached to the rig floor F. Alternatively, the inner barrel IB of the slip joint SJ can be unlocked and the seal housing 20 lifted to the diverter assembly DA, attached by the diverter D to the rig floor F, with the internal running tool. With the latching and locating pins installed, the internal running tool aligns the seal housing 20 and the diverter assembly DA. The seal housing 20 is then clamped to the diverter assembly DA with the quick connect clamp 44 and the latching pins removed. In the embodiment of FIG. 4, the seal housing 20 functions as a passive part of the conventional slip joints/diverter system.

Alternatively, the seal housing 20 does not have to be installed through the rotary table RT but can be installed using a hoisting cable passed through the rotary table RT. The hoisting cable would be attached to the internal running tool 60 positioned in the housing 20 and, as shown in FIG. 6, the riser guide 68 extending from the crossover 12. Upon positioning of the crossover 12 onto the inner barrel IB, the latching pins 64A, 64B are pulled and the running tool 60 is released. The bearing and seal assembly 10A is then inserted into the housing 20 after the slip joint SJ is locked and the seals in slip joint are fully pressurized. The connector 16, 18 and conduits 30, 32 are then attached to the seal housing 20.

As can now be understood, the rotatable seals 38, 42 of the assembly 10A seal the rotating tubular 14 and the seal housing 20, and in combination with the flexible conduits 30, 32 connected to a choke manifold CM provide a controlled pressurized mud system where relative vertical movement of the seals 38, 42 to the tubular 14 are reduced, that is desirable with existing and emerging pressurized mud return technology. In particular, this mechanically controlled pressurized system is useful not only in previously available underbalanced operations comprising drilling, completions and workovers, gas-liquid and systems and pressurized mud handling systems, but also in PMCD and reverse circulation system.

One advantage of the RCH 10 described above is that the RCH 10 allows use of a technique previously unavailable offshore, such as in floating rig, semi-submersible, or drillship operations. The RCH 10 allows use of PMCD and reverse circulation techniques previously used onshore or on bottom-supported fixed rigs, because the RCH 10 allows moving pressurized drilling fluid to a sealed riser while compensating for relative movement of the floating structure and the housing while drilling.

Figure 13:
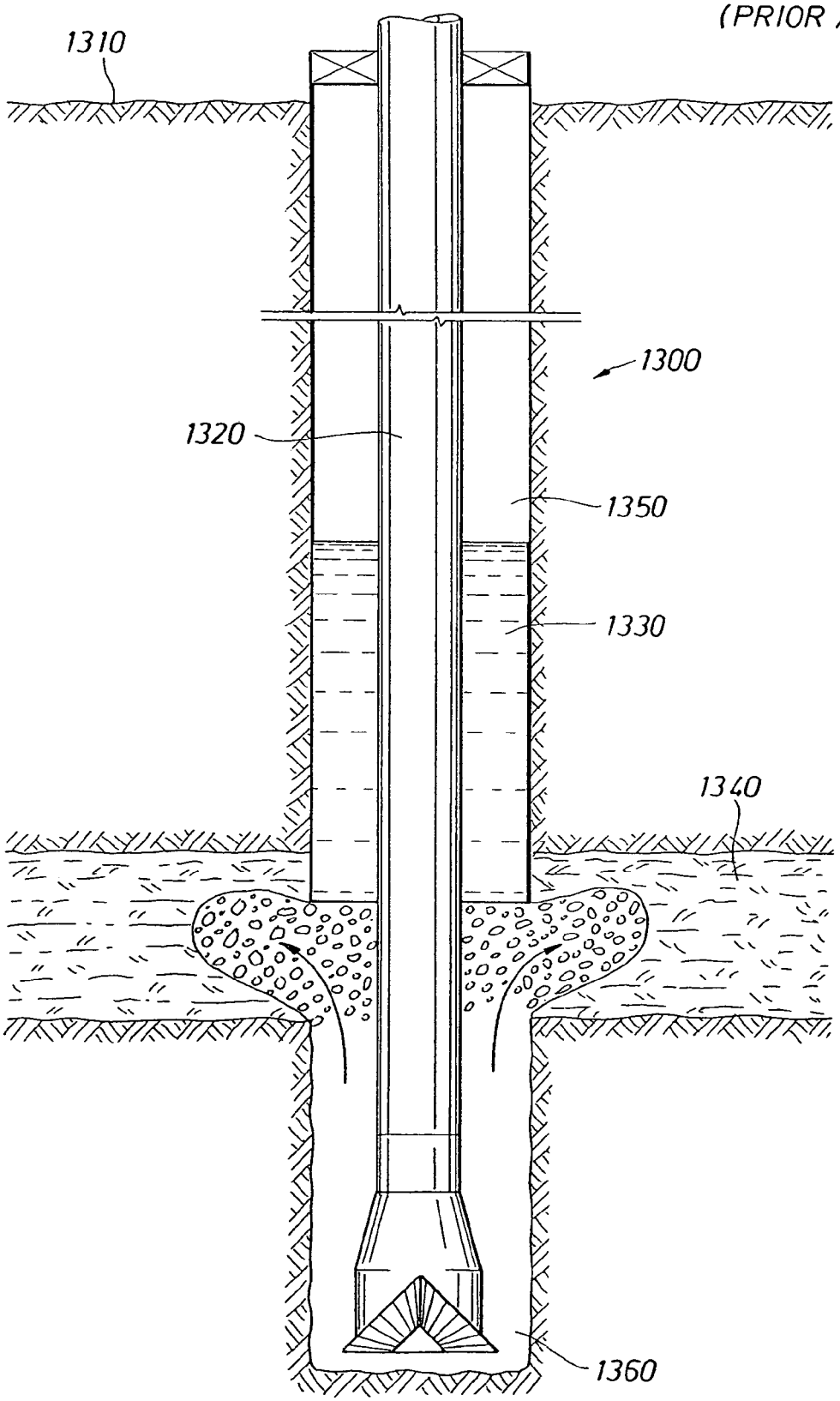
FIG.13 (PRIOR ART)
FIG. 13 is an elevational view of a prior art onshore well using pressurized mud cap drilling ("PMCD")

FIG. 13 is an elevational view showing a prior art onshore well 1300 below ground level 1310 using mud cap drilling. A mud cap 1330 is placed in the annulus 1350 surrounding the drill pipe 1320, capping the return flow from the borehole 1360 upwards through the annulus 1350. Cuttings and debris are shown extending outward from the borehole into a lost circulation or theft zone 1340. This mud cap drilling technique is well known for onshore wells and offshore fixed wells, but has been unavailable for offshore floating rigs because of the inability to handle the vertical and horizontal movements of the floating rig structure relative to the annulus, while sealing the top of the riser.

FIG. 14 is a simplified elevation view of an exemplary floating rig PMCD system according to one embodiment. An RCH 10, similar to one illustrated in FIGS. 2-12, may be used to form a mud cap in the annulus of the well, as will be described below, providing a closed and pressurizable annulus returns system as described above. Unlike non-PMCD drilling, where the mud return system allows mud to flow up the annulus and out through the flexible conduits 30 and 32 of FIG. 6 to provide a controlled pressurized mud return system, in a PMCD configuration the mud cap will be introduced into the annulus through the pressurized conduits, as described in detail below. Some of the features of the system illustrated in FIG. 2 have been omitted for clarity of FIG. 14.

As illustrated in FIG. 14, conduits 30 and 32 remain connected to the RCH 10 at the seal housing 20, just as in FIG. 2. However, instead of the conduit 30 communicating drilling fluid from the seal housing 20 to a fluid receiving device, the conduit 30 now communicates mud cap fluid from the mud pump MP into the seal housing, placing a pressurized mud cap 1330 into the annulus of the riser R above a theft zone 1340. As with conventional onshore mud cap drilling, the mud cap fluid will flow to the downhole area to form the mud cap 1330 above the borehole 1360, allowing debris and cuttings to flow into the theft zone 1340, instead of being circulated up the annulus as in a non-PMCD mud return. The annulus of riser R surrounding the rotatable tubular above the mud cap 1330 can be pressurized by additional drilling fluids introduced via the conduit 30. As in FIG. 2, conduit 32 may discharge into the atmosphere or may discharge to a choke manifold CM or directly to a separator MB or shale shaker SS. Conduit 32 may also communicate mud cap fluid from a mud pump into the seal housing. As with the system illustrated in FIG. 2, the flexible conduit 30 allows the system to compensate for vertical and horizontal movement of the floating structure S relative to the RCH 10 and riser R, allowing use of PMCD and reverse circulation techniques previously available only to non-floating structures. In PMCD drilling, well bore pressure management is typically achieved by pump rates, with drilling fluid pumped into the drill string as well as mud cap pumps down the annulus via the flexible conduit 30. However, other well bore pressure management techniques can be used.

Although the RCH 10, as shown in FIG. 14, could be joined to a blowout preventer (BOP) stack at the top of the riser R, one skilled in the art will recognize that the BOP stack can be positioned in the moonpool area of the rig above the surface of the water, e.g., slim riser deepwater drilling with a surface BOP, or subsea, e.g., deepwater drilling with a conventional marine riser and subsea BOP.

The same configuration illustrated in FIG. 14 also allows the use of reverse circulation techniques, also previously available only to onshore drillers. In reverse circulation, drilling fluid is pumped via the conduit 30 down the annulus of the riser R instead of down the drill string. Reverse circulation is used to free certain stuck pipe situations or to import higher hydrostatic head pressure in the open hole below the casing, typically for stabilizing the well bore, preventing well bore collapse. Although well bore instability is common in marine environments, reverse circulation has not been possible on floating marine structures, again because of the relative movement between the floating structure and the riser.

Figure 15:
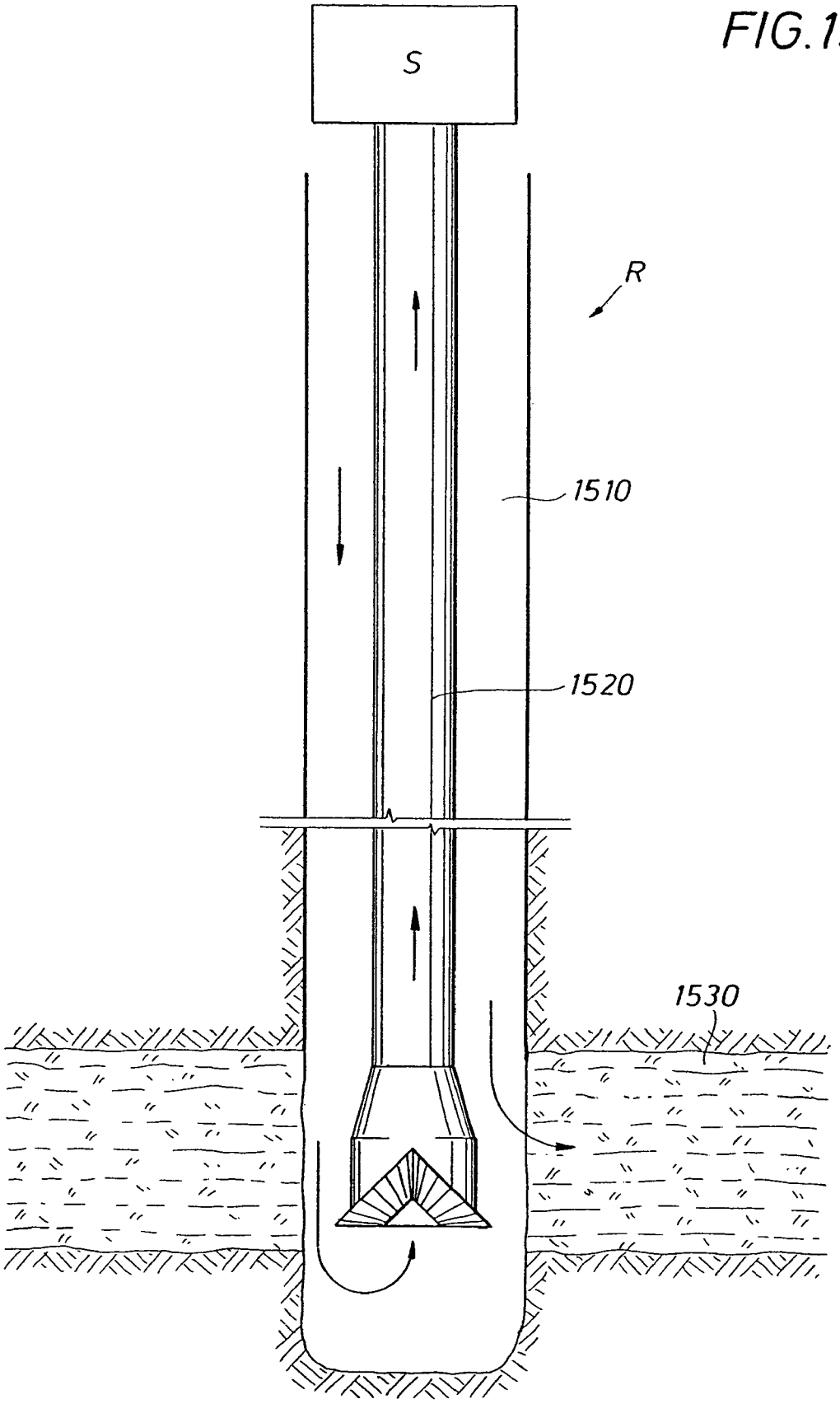
FIG. 15 is an elevational view of a downhole portion of the riser R in a reverse circulation drilling embodiment using the exemplary floating rig illustrated in FIG. 14.

FIG. 15 is a detail elevational view of a downhole portion of the riser R of FIG. 14 when the exemplary floating rig system of FIG. 14 is used for reverse circulation drilling instead of PMCD. Drilling fluid can be pumped down the annulus 1510 of the riser R instead of down the drill string 1520, or at a higher pressure than drilling fluid being pumped down the drill string 1520. A portion of the drilling fluid then flows back up the drill string 1520, returning to the floating structure S. In some environments, such as where a theft zone 1530 exists, some of the annulus-pumped drilling fluid may flow into the theft zone 1530 instead of flowing up the drill string 1520.

The foregoing disclosure and description of the invention are illustrative and explanatory thereof, and various changes in the details of the illustrated apparatus and construction and the method of operation may be made without departing from the spirit of the invention.

I claim:

1. A method for drilling in a floor of an ocean from a structure floating at a surface of the ocean using a rotatable tubular, a riser and a drilling fluid, comprising the steps of:

positioning at least a portion of a housing above the surface of the ocean;

allowing the floating structure to move independent of the housing;

communicating the drilling fluid from the floating structure to an annulus of the riser surrounding the rotatable tubular, comprising the steps of:

compensating for relative movement of the floating structure and the housing, comprising the steps of:

attaching a flexible conduit between the housing and the floating structure; and moving the drilling fluid through the flexible conduit to the housing, and moving the drilling fluid through the housing and into the annulus.

2. The method of claim 1, wherein the step of positioning at least a portion of the housing above the surface of the ocean comprising the step of:

lowering the housing through a deck of the floating structure.

3. The method of claim 1, further comprising the step of:

creating a mud cap at a downhole location.

4. The method of claim 1, further comprising the steps of:
moving the drilling fluid down the annulus; and
returning a portion of the drilling fluid up the rotatable tubular.

5. The method of claim 1, further comprising the step of:
pressurizing the drilling fluid to a predetermined pressure.

6. A method for communicating drilling fluid from a structure floating at a surface of an ocean to a casing fixed relative to an ocean floor while rotating within the casing a tubular, comprising the steps of:
fixing a housing with the casing adjacent a first level of the floating structure;
allowing the floating structure to move independent of the housing;
moving the drilling fluid from a second level of the floating structure above the housing down the casing; and
rotating the tubular relative to the housing,
wherein at least a portion of the housing is above the surface of the ocean,
wherein a seal is within the housing, and
wherein the seal contacts and moves with the tubular while the tubular is rotating.

7. The method of claim 6, further comprising the step of:
compensating for relative movement of the structure and the housing during the step of moving.

8. The method of claim 6, further comprising the step of:
pressurizing the drilling fluid to a predetermined pressure as the drilling fluid flows into the casing.

9. The method of claim 6, further comprising the step of:
creating a mud cap at a downhole location.

10. The method of claim 6, further comprising the step of:
returning a portion of the drilling fluid up the tubular to the floating structure while rotating the tubular.

11. A method for drilling in a floor of an ocean from a structure floating at a surface of the ocean using a rotatable tubular and a drilling fluid, comprising the steps of:
positioning a housing above a portion of a riser;
allowing the floating structure to move independent of the housing; and
communicating the drilling fluid from the structure to an annulus of the riser surrounding the rotatable tubular, comprising the step of:
moving the drilling fluid through a flexible conduit between the floating structure and the riser.

12. The method of claim 11, the step of communicating the drilling fluid further comprising the steps of:
moving a predetermined volume of the drilling fluid down the annulus; and
forming a mud cap.

13. The method of claim 11, the step of communicating the drilling fluid further comprising the steps of:
moving the drilling fluid down the annulus of the riser; and
returning a portion of the drilling fluid up the rotatable tubular towards the floating structure.

14. The method of claim 11, further comprising the step of:
pressurizing the drilling fluid to a predetermined pressure.

15. A method for drilling in a floor of an ocean from a structure floating at a surface of the ocean using a rotatable tubular and a drilling fluid, comprising the steps of:
removably inserting a rotatable seal in a portion of a riser;
allowing the floating structure to move independent of the riser;
communicating the drilling fluid from the floating structure to an annulus of the riser surrounding the rotatable tubular;
compensating for relative movement of the floating structure and the riser with a flexible conduit; and
forming a mud cap from the drilling fluid.

16. The method of claim 15, further comprising the step of:
pressurizing the drilling fluid to a predetermined pressure.

17. A method for drilling in a floor of an ocean from a structure floating at a surface of the ocean using a rotatable tubular and a pressurized drilling fluid, comprising the steps of:
removably inserting a rotatable seal in a portion of a riser;
allowing the floating structure to move independent of the riser;
communicating the pressurized drilling fluid from the floating structure to an annulus of the riser surrounding the rotatable tubular;
compensating for relative movement of the floating structure and the riser with a flexible conduit;
moving the pressurized drilling fluid down the annulus; and
moving a portion of the pressurized drilling fluid up the rotatable tubular towards the floating structure.

18. A method for drilling in a floor of an ocean from a structure floating at a surface of the ocean using a rotatable tubular and a drilling fluid, comprising the steps of:
positioning a rotatable seal above an upper portion of a riser, the floating structure movable independent of the rotatable seal;
pumping the drilling fluid from the floating structure through a flexible conduit between the floating structure and the riser;
moving the drilling fluid from the floating structure through an annulus of the riser surrounding the rotatable tubular; and
forming a mud cap.

19. The method of claim 18, wherein the step of pumping the drilling fluid comprises the step of:
pumping a volume of the drilling fluid from the floating structure through the flexible conduit between the floating structure and the housing.

20. The method of claim 18, wherein the step of pumping the drilling fluid comprises the step of:
maintaining a desired pressure of the drilling fluid by a pump rate.

21. The method of claim 18, further comprising the step of:
allowing debris and cuttings to flow into a theft zone below the mud cap.

22. The method of claim 18, further comprising the step of:
pumping the drilling fluid down the rotatable tubular.

23. The method of claim 18, further comprising the step of:
pressurizing the drilling fluid to a predetermined pressure.

24. The method of claim 18, further comprising the step of:
pressurizing additional drilling fluid above the mud cap to allow debris and cuttings to flow into a theft zone instead of being circulated up the annulus.

25. A method for drilling from a structure floating at a surface of an ocean, comprising:
coupling the floating structure and a riser with a flexible conduit;
moving a drilling fluid from the floating structure via the flexible conduit to an annulus of the riser surrounding a rotatable tubular; and
circulating a portion of the drilling fluid down the annulus.

26. The method of claim 25, further comprising the step of:

pressurizing the drilling fluid to a predetermined pressure as the drilling fluid flows into the annulus.

27. The method of claim 25, wherein the step of moving the drilling fluid from the floating structure comprising the steps of:

pumping the drilling fluid through the flexible conduit; and managing a pressure of the drilling fluid in the annulus by controlling a pumping rate of the drilling fluid.

28. The method of claim 25, further comprising the step of:

sealing the rotatable tubular to the riser with a rotatable seal, the rotatable seal rotating with the rotatable tubular.

29. The method of claim 28, wherein the flexible conduit communicates the drilling fluid to the annulus below the rotatable seal.

30. The method of claim 25, further comprising the steps of:

sealing the rotatable tubular to the riser with a rotatable seal, the rotatable seal rotating with the rotatable tubular; and maintaining a predetermined pressure of the drilling fluid with the rotatable seal.

31. The method of claim 25, further comprising the steps of:

moving the drilling fluid from the floating structure to the rotatable tubular; and pressurizing the drilling fluid in the annulus at a higher pressure than the pressure of the drilling fluid in the rotatable tubular.

32. A method for drilling from a structure floating at a surface of an ocean, comprising the steps of:

disposing a housing with a portion of a riser, a portion of the housing extending above the surface of the ocean;

creating a mud cap at a downhole location, comprising:

communicating a drilling fluid from the floating structure to the housing via a flexible conduit;

moving the drilling fluid through the housing and into an annulus of the riser surrounding a tubular; and moving the drilling fluid to a downhole location.

33. The method of claim 32, further comprising the steps of:

introducing additional drilling fluids through the flexible conduit and into the annulus; and pressurizing the annulus above the mud cap with the additional drilling fluids.

34. The method of claim 32, wherein the step of communicating the drilling fluid from the floating structure via the flexible conduit comprising the step of:

communicating the drilling fluid from a mud pump via the flexible conduit.

35. The method of claim 32, further comprising the step of:

compensating for relative movement of the floating structure and the housing using the flexible conduit.

36. The method of claim 32, wherein the housing is a housing sized for receiving a rotating control head.

37. The method of claim 32, further comprising the step of:

allowing debris and cuttings to flow into a theft zone.

38. The method of claim 32, wherein the housing comprising:

a rotatable seal disposed with and sealing the tubular with the riser.

39. The method of claim 32, wherein the downhole location is a predetermined downhole location.

40. The method of claim 32, wherein the step of communicating the drilling fluid comprising the step of:

communicating a predetermined volume of the drilling fluid.

41. The method of claim 32, wherein the step of communicating the drilling fluid from the floating structure via the flexible conduit comprising the steps of:

pumping the drilling fluid from a mud pump via the flexible conduit into the tubular; and managing a well bore pressure by a pump rate.

42. A method for moving a drilling fluid using a structure floating at a surface of an ocean, comprising the steps of:

coupling the floating structure and a riser with a flexible conduit;

moving the drilling fluid from the floating structure via the flexible conduit to an annulus of the riser surrounding a tubular; and moving a portion of the drilling fluid down the annulus.

43. The method of claim 42, further comprising the step of drilling from the structure.

44. The method of claim 42, wherein the tubular is rotatable.

45. The method of claim 42, further comprising the step of moving the portion of the drilling fluid, which has been moved down the annulus, up the tubular, and wherein the step of moving the portion comprises moving the portion of the drilling fluid down the annulus and up the tubular.

46. The method of claim 42, further comprising the step of:

pressuring the drilling fluid to a predetermined pressure as the drilling fluid flows into the annulus.

47. The method of claim 42, wherein the step of moving the drilling fluid from the floating structure comprises the steps of:

pumping the drilling fluid through the flexible conduit; and managing a pressure of the drilling fluid in the annulus by controlling a pump rate of the drilling fluid.

48. The method of claim 42, further comprising the step of:

sealing the tubular to the riser with a rotatable seal, the rotatable seal being arranged to rotate with the tubular.

49. The method of claim 48, further comprising the step of:

maintaining a predetermined pressure of the drilling fluid with the rotatable seal.

50. The method of claim 48, wherein the flexible conduit communicates the drilling fluid to the annulus below the rotatable seal.

51. The method of claim 42, further comprising the steps of:

moving the drilling fluid from the floating structure to the tubular; and pressurizing the drilling fluid in the annulus at a higher pressure than the pressure of the drilling fluid in the tubular.

52. The method of claim 42, further comprising the step of:

creating a mud cap.

* * * * *